US011048191B2

(12) United States Patent
Fumoto et al.

(10) Patent No.: US 11,048,191 B2
(45) Date of Patent: Jun. 29, 2021

(54) DEVELOPER SUPPLY CONTAINER

(71) Applicant: CANON KABUSHIKI KAISHA, Tokyo (JP)

(72) Inventors: Masataka Fumoto, Tokyo (JP); Dai Kanai, Abiko (JP); Kiyoshi Oyama, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/555,253

(22) Filed: Aug. 29, 2019

(65) Prior Publication Data

US 2020/0073289 A1 Mar. 5, 2020

(30) Foreign Application Priority Data

Aug. 30, 2018 (JP) ..... JP2018-162135

(51) Int. Cl.
*G03G 15/08* (2006.01)

(52) U.S. Cl.
CPC ..... *G03G 15/0898* (2013.01)

(58) Field of Classification Search
CPC ..... G03G 15/0872; G03G 15/0881; G03G 15/0898
See application file for complete search history.

(56) References Cited

U.S. PATENT DOCUMENTS 5,828,935 A * 10/1998 Tatsumi ..... G03G 15/0855 399/260
6,104,900 A * 8/2000 Ishikawa ..... G03G 15/0126 399/227
6,298,208 B1 * 10/2001 Kawamura ..... G03G 15/0868 399/103
6,944,417 B2 * 9/2005 Yamada ..... G03G 15/0868 222/DIG. 1

(Continued)

FOREIGN PATENT DOCUMENTS

JP 2006-308781 A 11/2006

OTHER PUBLICATIONS

Copending U.S. Appl. No. 16/555,253, filed Aug. 27, 2019.
Jun. 8, 2020 Extended Search Report in European Patent Application No. 19 192 041.2.

*Primary Examiner* — Walter L Lindsay, Jr.
*Assistant Examiner* — Milton Gonzalez
(74) *Attorney, Agent, or Firm* — Venable LLP

(57) ABSTRACT

A developer supply container includes a developer accommodating portion having one end provided with an opening, and drive receiving portion, a discharging portion including a receiving portion into which the one end of the accommodating portion is inserted, and a developer discharge opening, the accommodating portion being mounted to the discharging portion rotatably relative to the discharging portion; a sealing member sealing between the one end and the receiving portion; a projection radially projecting from (Continued)

an outer peripheral surface of the accommodating portion; and a first restricting portion and a second restricting portion provided on the receiving portion of the discharging portion at positions upstream and downstream of the projection, respectively in the inserting direction and contactable to the projection to restrict an inclination of the rotational axis of the accommodating portion relative to the inserting direction within a predetermined range.

3 Claims, 17 Drawing Sheets

(56) References Cited

U.S. PATENT DOCUMENTS

| | | | | |
|---|---|---|---|---|
| 7,962,064 | B2 * | 6/2011 | Asai | G03G 15/087 399/12 |
| 7,983,592 | B2 * | 7/2011 | Naito | G03G 15/0872 399/106 |
| 8,155,568 | B2 * | 4/2012 | Naito | G03G 15/087 399/262 |
| 8,326,194 | B2 | 12/2012 | Nakagaki et al. | |
| 8,478,171 | B2 * | 7/2013 | Sasaki | G03G 15/087 399/120 |
| 8,532,522 | B2 * | 9/2013 | Kawamura | G03G 15/0872 399/102 |
| 9,429,904 | B2 | 8/2016 | Yasumoto et al. | |
| 9,632,457 | B2 | 4/2017 | Koseki et al. | |
| 10,197,960 | B2 | 2/2019 | Torikata et al. | |
| 2006/0104660 | A1 | 5/2006 | Doi et al. | |
| 2016/0313677 | A1 | 10/2016 | Oyama | |
| 2018/0157203 | A1 | 6/2018 | Mori et al. | |
| 2019/0354044 | A1 | 11/2019 | Torimaru et al. | |

* cited by examiner (a)

(b)

(a)

(b)

(a)

(b)

(a)

(b)

(a)

(b)

DEVELOPER SUPPLY CONTAINER

FIELD OF THE INVENTION AND RELATED ART

The present invention relates to a developer supply container suitably usable with an image forming apparatus of a electrophotographic type, such as a printer, a copying machine, a facsimile machine, a multifunction machine and so on.

In an image forming apparatus of the electrophotographic type, an image is formed using the developer, and the developer is consumed in accordance with the image forming operation. Therefore, the image forming apparatus is equipped with a developer supply device for supplying the developer into the image forming apparatus. Japanese Laid-open Patent Application 2006-308781 discloses a developer supplying apparatus to which a developer supply container containing the developer to be supplied into the image forming apparatus is detachably mountable. The developer supply container comprises a discharging chamber (discharging portion) provided with a discharge opening, and an accommodating chamber (accommodating portion) capable of accommodating the developer, the accommodating chamber being rotatable relative to the discharging portion. The accommodating portion is engaged with the discharging portion with a gap in order to permit the rotation (loose fitting), and therefore, a sealing member in the form of a ring is provided to prevent leakage of the developer through the gap the to the outside of the developer supply container.

When the loose fitting is used between the accommodating portion and the discharging portion, a whirling motion tends to occur in which the accommodating portion moving in the radial direction crossing with the rotational axis direction, due to variations in the parts of the device and variation in the rotational load, or the like. If this occurs, there is a liability that the developer leaks through the contact portion between the accommodating portion and the sealing member. For this reason, an elastic sealing member is used, and the sealing member is compressed in the rotational axis direction by the discharging portion and the accommodating portion, so as to suppress the whirling motion of the accommodating portion. In addition, with the structure disclosed in the Japanese Laid-open Patent Application 2006-308781, a contact surface of the sealing member in the discharging portion or the accommodating portion is slanted, so that a strong force is produced by the sealing member against the whirling motion during the rotation of the accommodating portion, in order to suppress the whirling motion.

When the loose fitting is used between the accommodating portion and the discharging portion, the accommodating portion may rotate with inclination in the radial direction relative to the discharging portion. Particularly when the accommodating portion is rotated through a driving force transmission from an external driving source using a gear portion provided at the outer circumferential periphery of the accommodating portion (a radial forces applied by the driving load), the accommodating portion may rotate with the inclination relative to the discharging portion. With the structure of the developer supply container disclosed in the above-mentioned patent document, the whirling may occur with the accommodating portion inclined. In such a case, the pressure applied in the rotational axis direction to the sealing member is not even over the circumference. Then, the sealing member may be locally deformed at the position where the pressure is large. If this occurs, the elasticity of the sealing member at such a position is lost, with the result that the information may increase to such an extent that a gap is produced between the sealing member.

Accordingly, it is a object of the present invention to provide a developer supply container in which the whirling of the accommodating portion is suppressed by the sealing member, and that deformation of the sealing member attributable to the rotation of the accommodating portion with the inclination relative to the discharging portion is suppressed.

Further features of the present invention will become apparent from the following description of exemplary embodiments with reference to the attached drawings.

SUMMARY OF THE INVENTION

According to an aspect of the present invention, there is provided a developer supply container comprising an accommodating portion including one end portion provided with an opening, and drive receiving portion provided at a outer circumference and configured to receive a rotational driving force from a outside, wherein a developer accommodated in said accommodating portion is fed toward the opening by rotation of said accommodating portion: a discharging portion including a receiving portion into which said one end portion of said accommodating portion is inserted, and a discharge opening configured to discharge the developer supplied through said opening of said accommodating portion, wherein said accommodating portion is mounted to said discharging portion so as to be rotatable relative to said discharging portion; a sealing member configured to seal between said one end portion and said receiving portion by being elastically compressed between said one end portion of said accommodating portion and a part of said receiving portion of said discharging portion, with respect to a direction in which said one end portion is inserted into said accommodating portion; a projection projecting from an outer peripheral surface of said accommodating portion in a radial direction crossing with a rotational axis direction of said accommodating portion; and a first restricting portion and a second restricting portion provided on said receiving portion of said discharging portion at positions upstream and downstream of said projection, respectively in the inserting direction and contactable to said projection to restrict an inclination of the rotational axis of said accommodating portion relative to the inserting direction within a predetermined range.

According to another aspect of the present invention, there is provided a developer supply container comprising: an accommodating portion including one end portion provided with an opening, and drive receiving portion provided at a outer circumference and configured to receive a rotational driving force from a outside, wherein a developer accommodated in said accommodating portion is fed toward the opening by rotation of said accommodating portion: a discharging portion including a receiving portion into which said one end portion of said accommodating portion is inserted, and a discharge opening configured to discharge the developer supplied through said opening of said accommodating portion, wherein said accommodating portion is mounted to said discharging portion so as to be rotatable relative to said discharging portion; a sealing member configured to seal between said one end portion and said receiving portion by being elastically compressed between said one end portion of said accommodating portion and a part of said receiving portion of said discharging portion, with respect to a direction in which said one end portion is inserted into said accommodating portion; a first projection and a second projection arranged in the inserting direction with a space therebetween, said first projection and said second projection projecting from a outer peripheral surface of said accommodating portion in a radial direction crossing with a rotational axis direction of said accommodating portion; and a restricting portion provided on said receiving portion of said discharging portion at a position between said first projection and said second projection in the inserting direction and contactable to said second projection to restrict an inclination of said rotational axis of said accommodating portion relative to the inserting direction.

Figure 3:
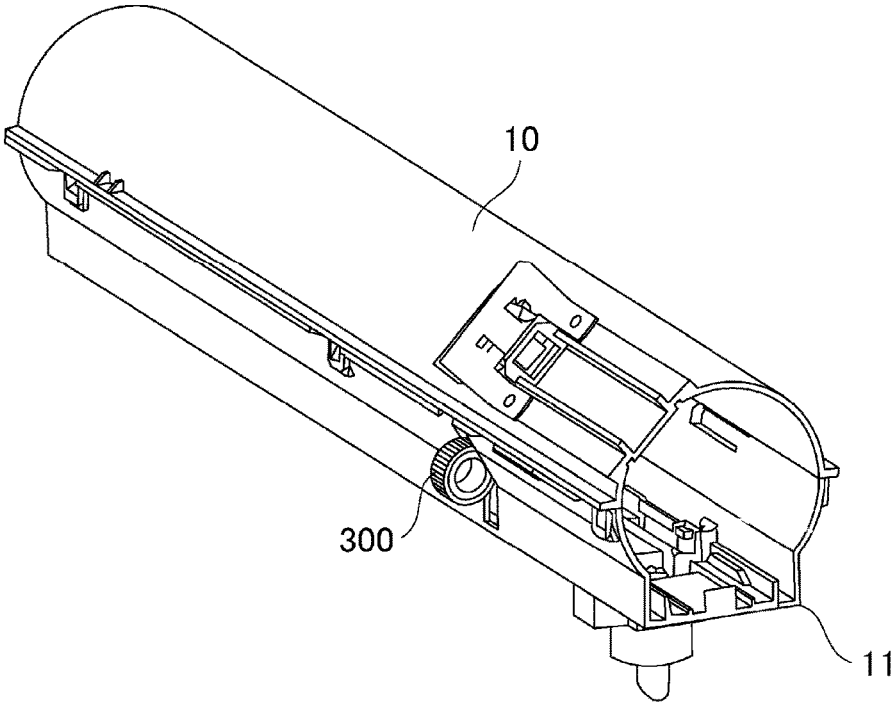
Figure 3:
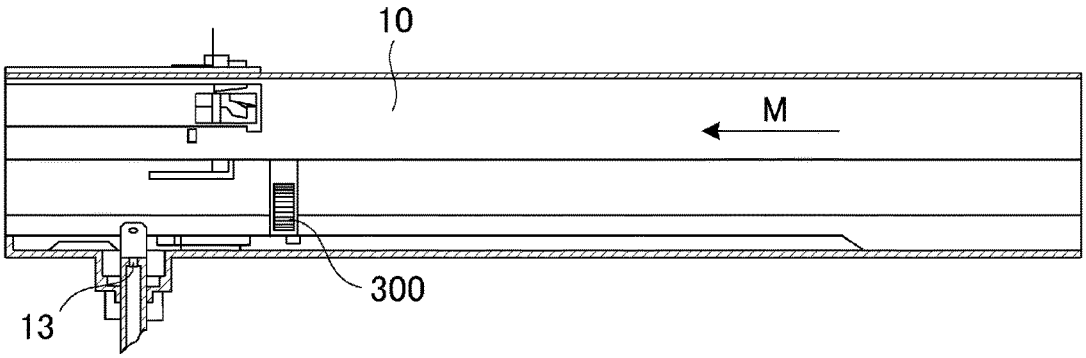

Part (a) of FIG. 3 is a perspective view of an outer appearance of a mounting portion, and part (b) of FIG. 3 is a sectional view of the mounting portion.

Figure 4:
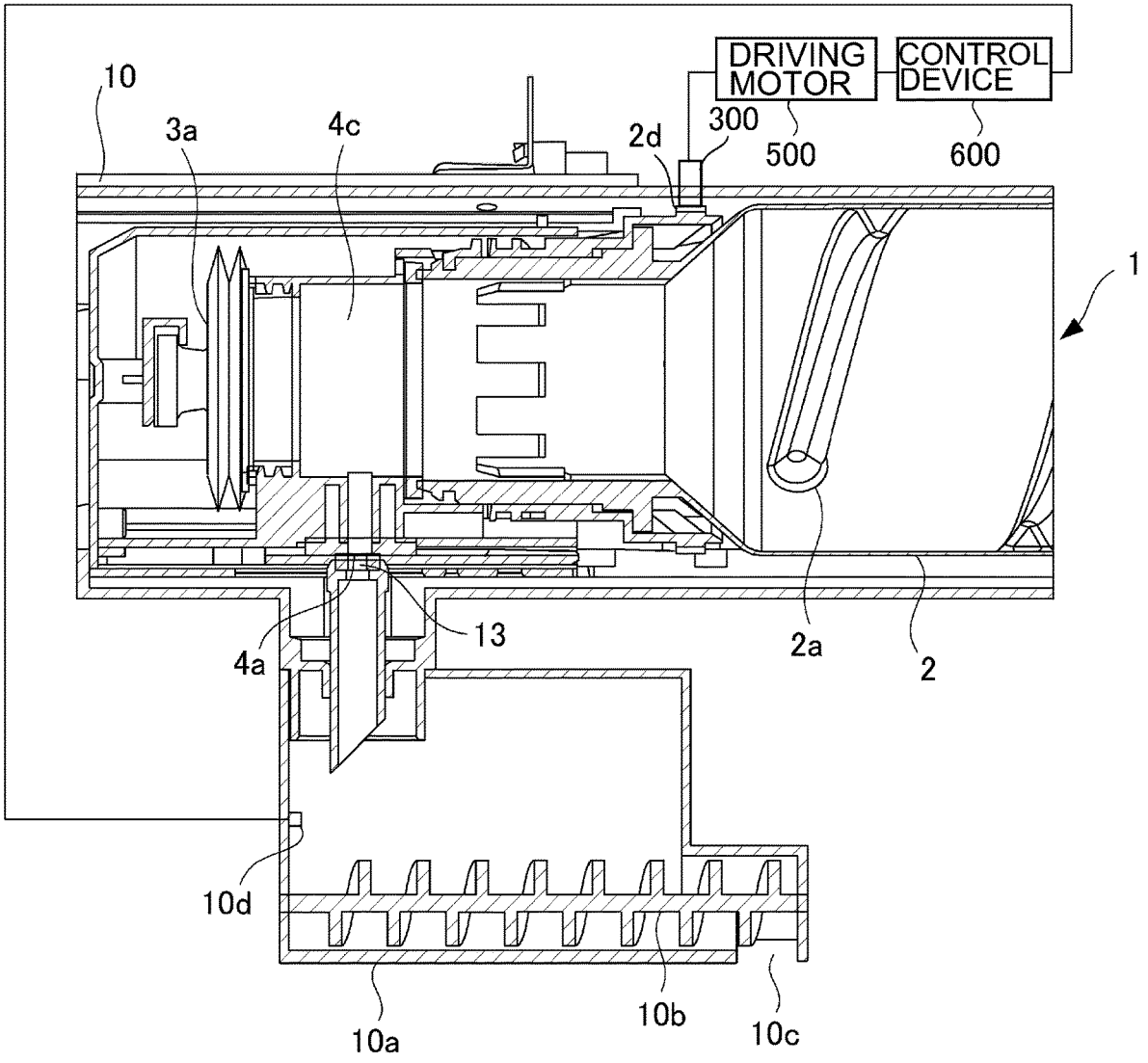

FIG. 4 is an enlarged view illustrating the developer supply container and a developer supplying apparatus.

Figure 5:
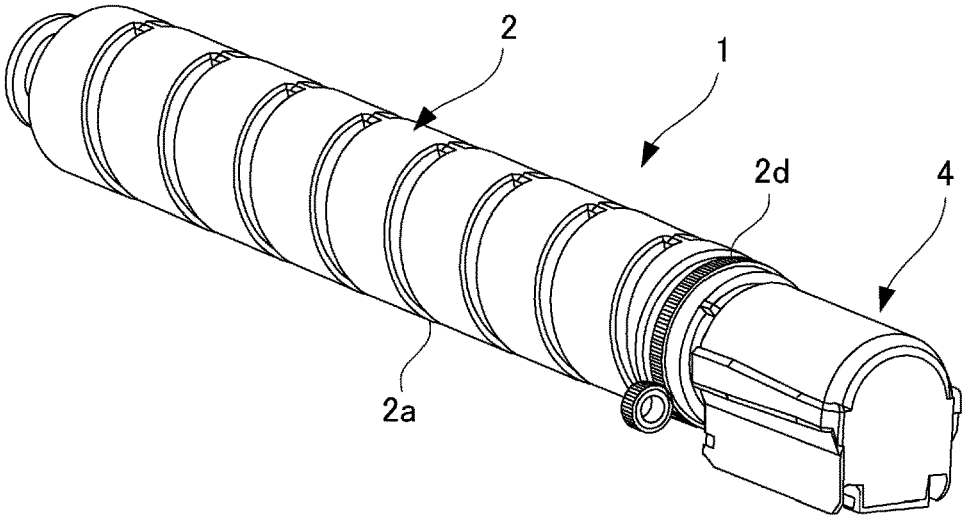
Figure 5:
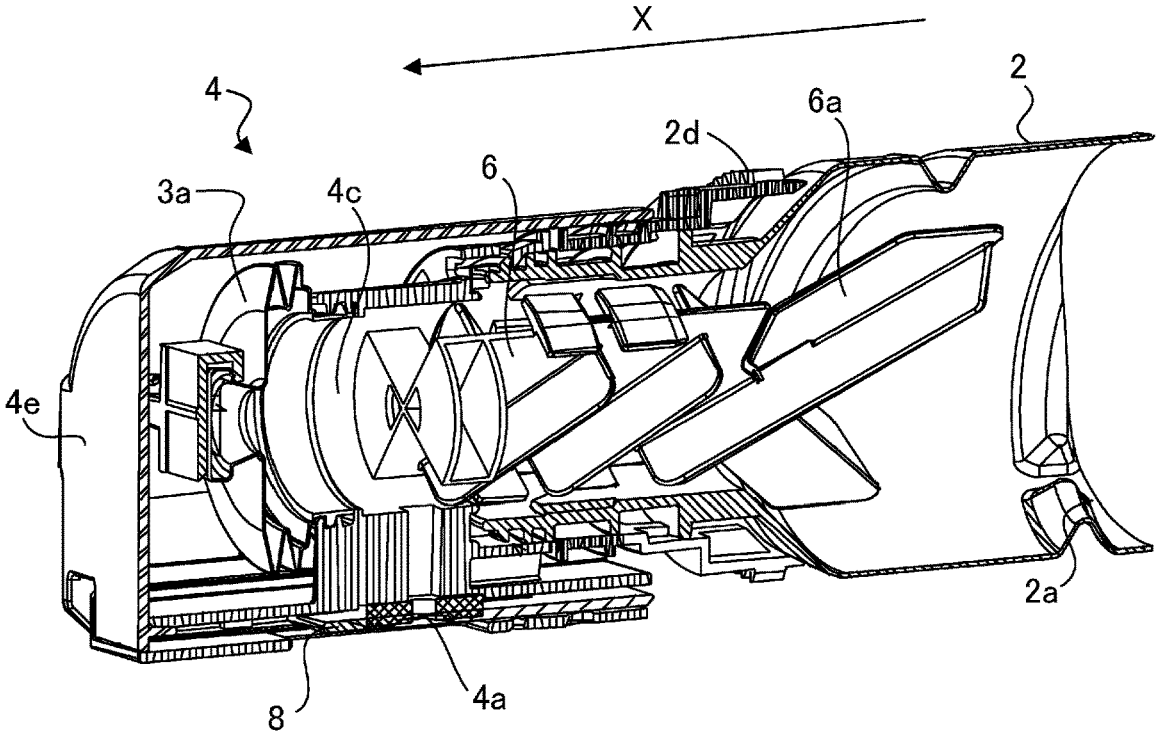

Part (a) of FIG. 5 is a perspective view of an outer appearance of the developer supply container, and part (b) of FIG. 5 is a perspective section of view of the developer supply container.

Figure 6:
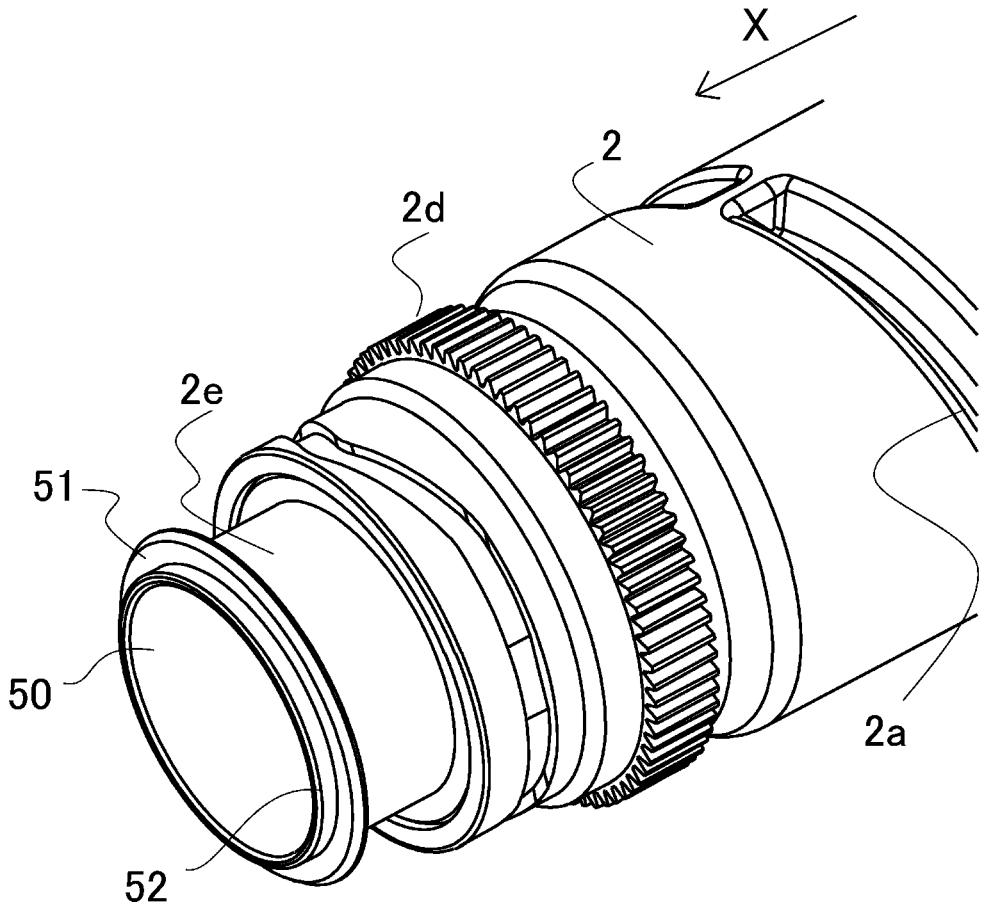

FIG. 6 is an enlarged perspective view of an accommodating portion according to a further embodiment of the present invention.

Figure 7:
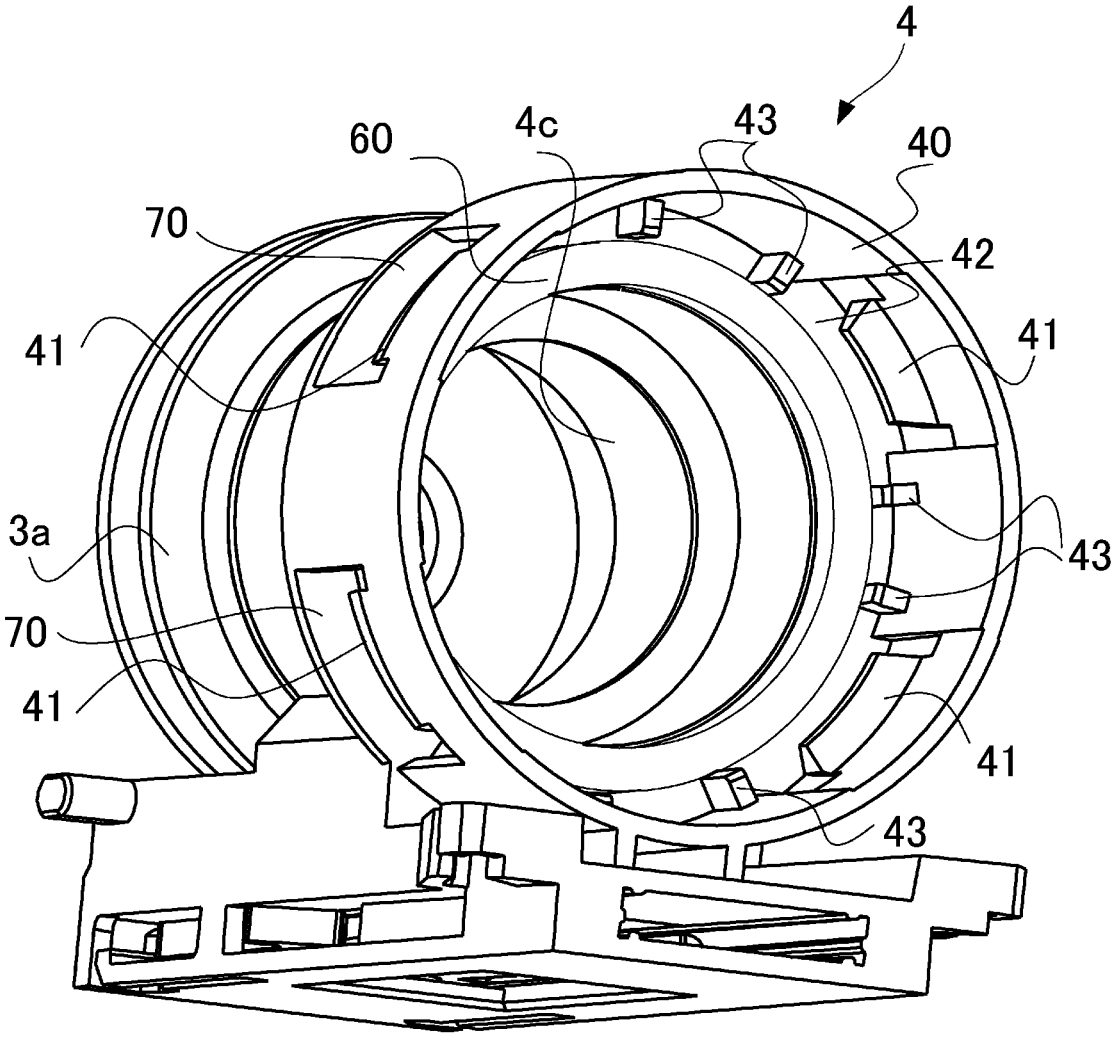

FIG. 7 is a perspective view of a flange portion in the first embodiment.

Figure 8:
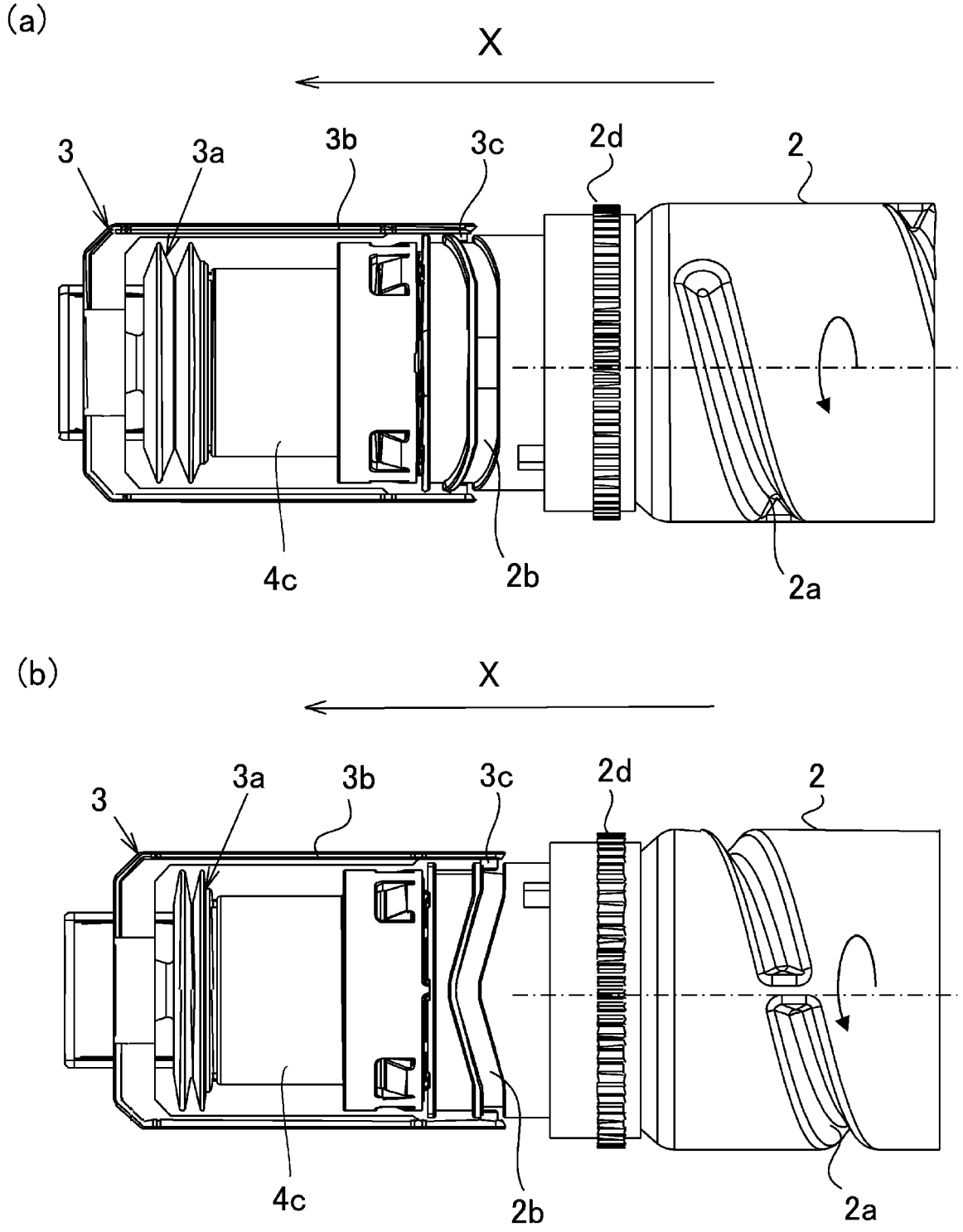

Part (a) of FIG. 8 is a partial view in a state in which a pump portion is expanded to the maximum usable limit, and part (b) of FIG. 8 is a partial view in a state in which the pump portion is contracted to the minimum usable limit.

Figure 9:
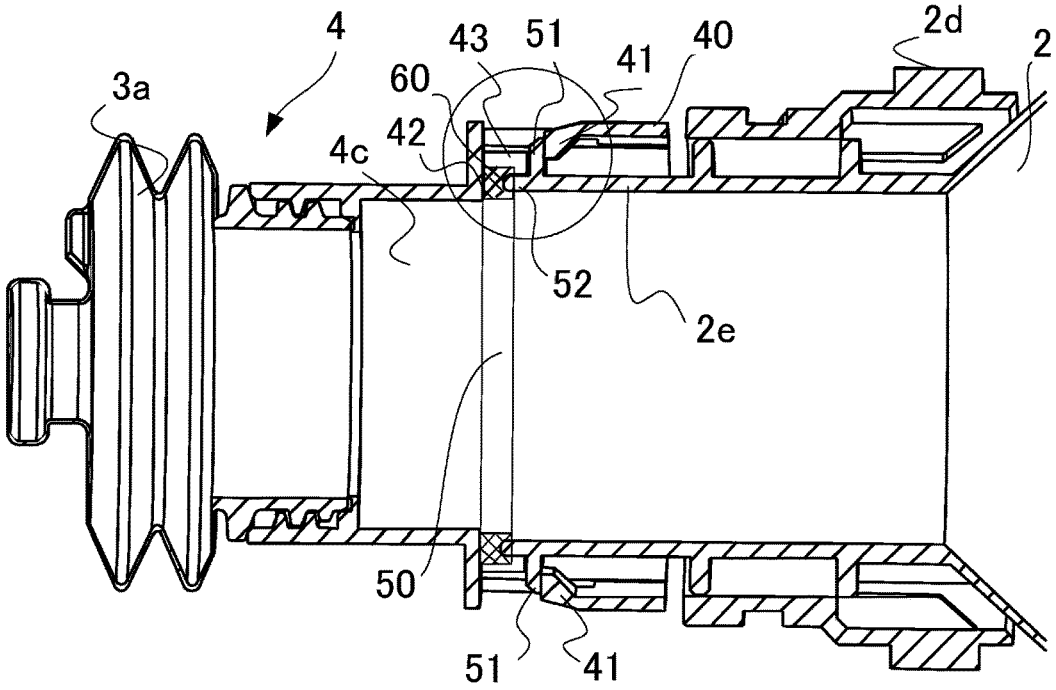
Figure 9:
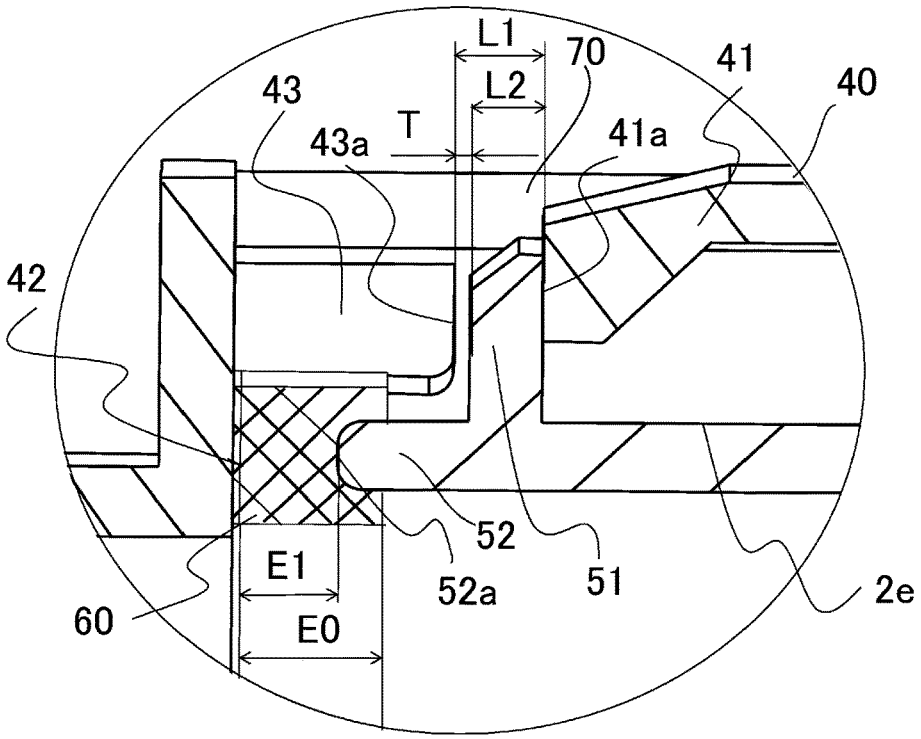

Part (a) of FIG. 9 is a partial sectional view illustrating the mounting of a flange portion and the accommodating portion, in the first embodiment, and part (b) is a partial enlarged view illustrating the mounting of the flange portion and the accommodating portion, in the first embodiment.

Figure 10:
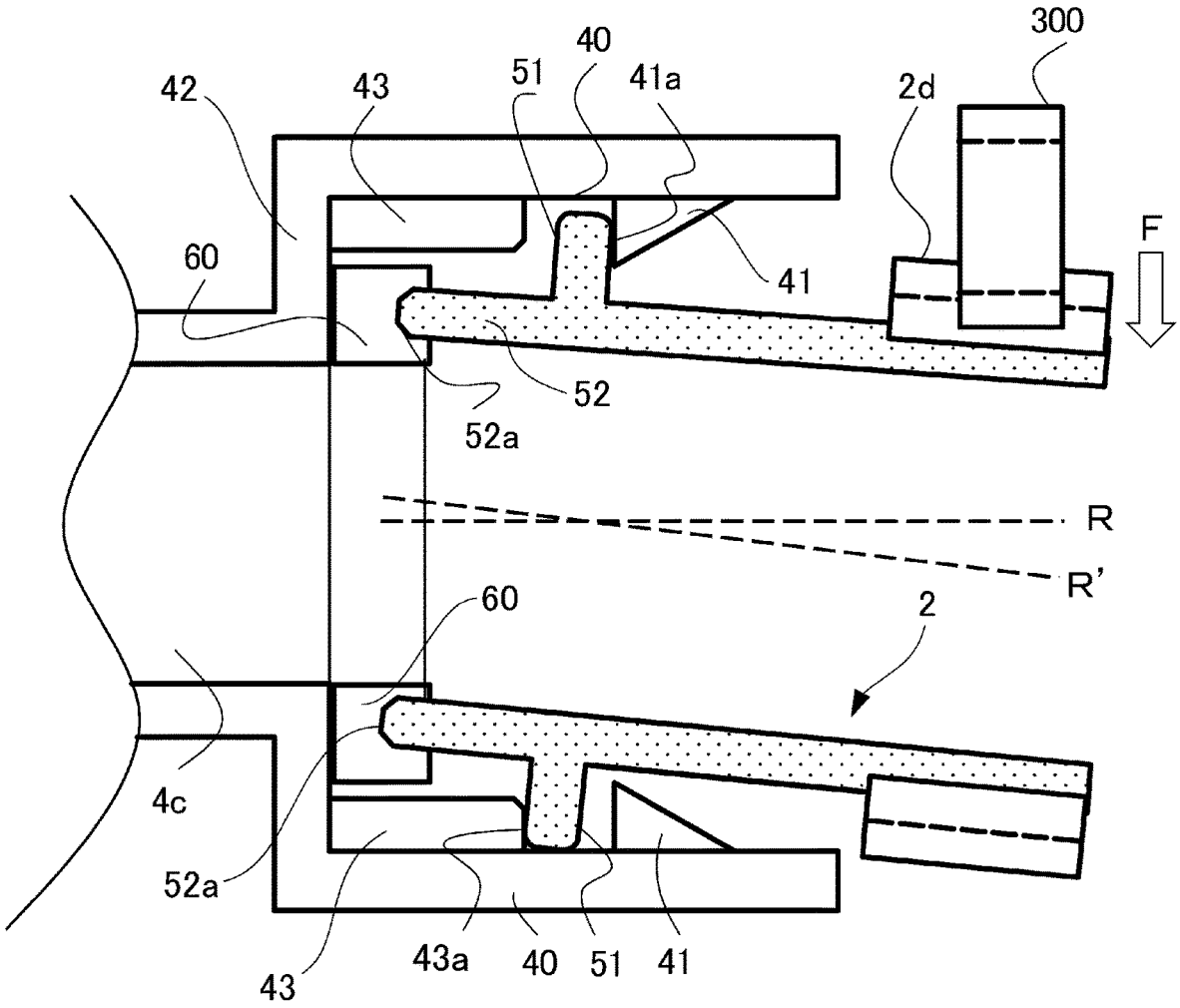

FIG. 10 is a schematic view illustrating restriction of the accommodating portion relative to the flange portion, in the first embodiment.

Figure 11:
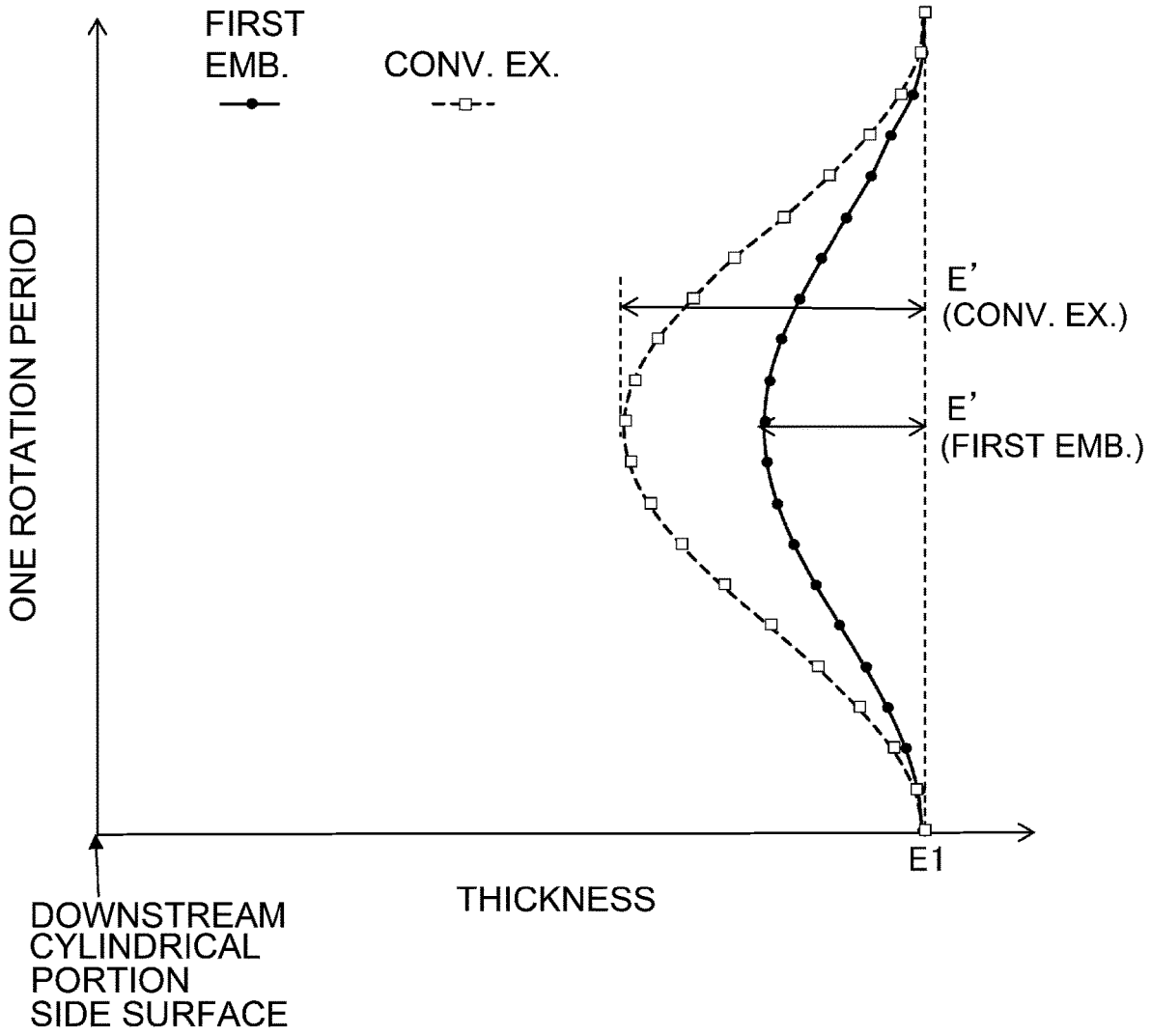

FIG. 11 is a graph of comparison between the embodiment and a comparison the example in deformation of a sealing member.

Figure 12:
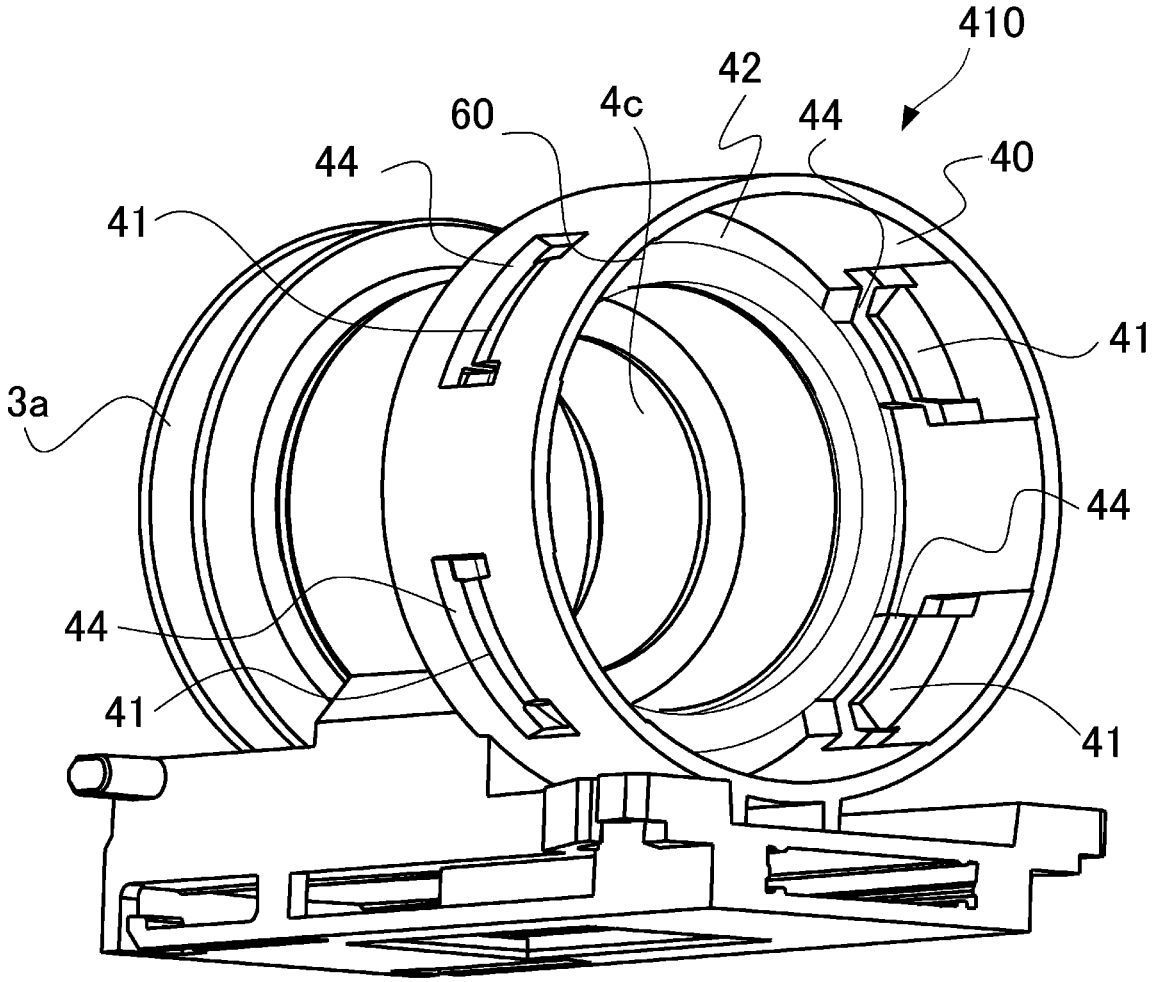

FIG. 12 is a perspective view of a flange portion in the second embodiment of the present invention.

Figure 13:
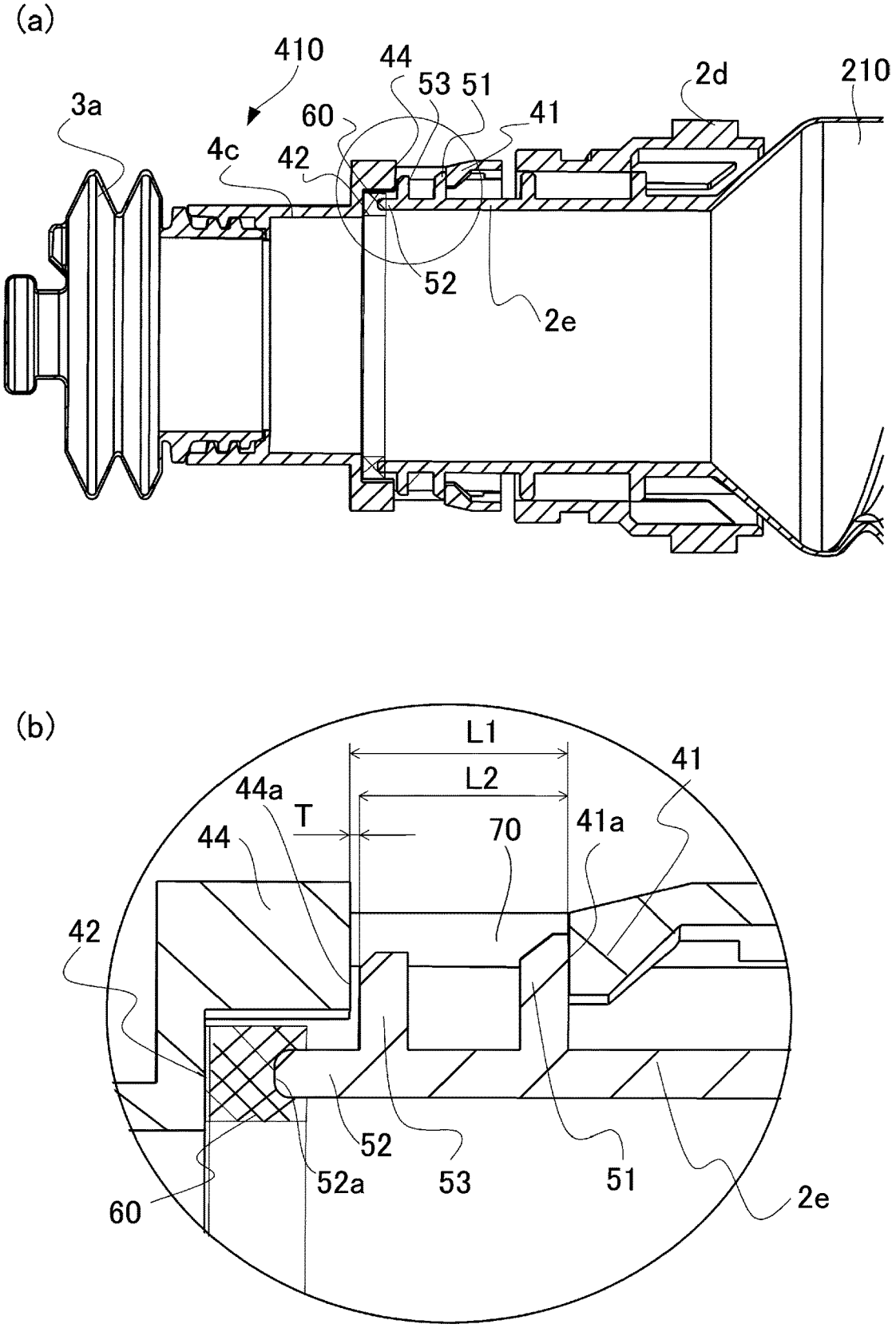

Part (a) of FIG. 13 is a partial sectional view illustrating mounting of the flange portion and the accommodating portion, in the second embodiment of the present invention, and part (b) of FIG. 13 is a partial enlarged sectional view illustrating mounting of the flange portion and the accommodating portion.

Figure 14:
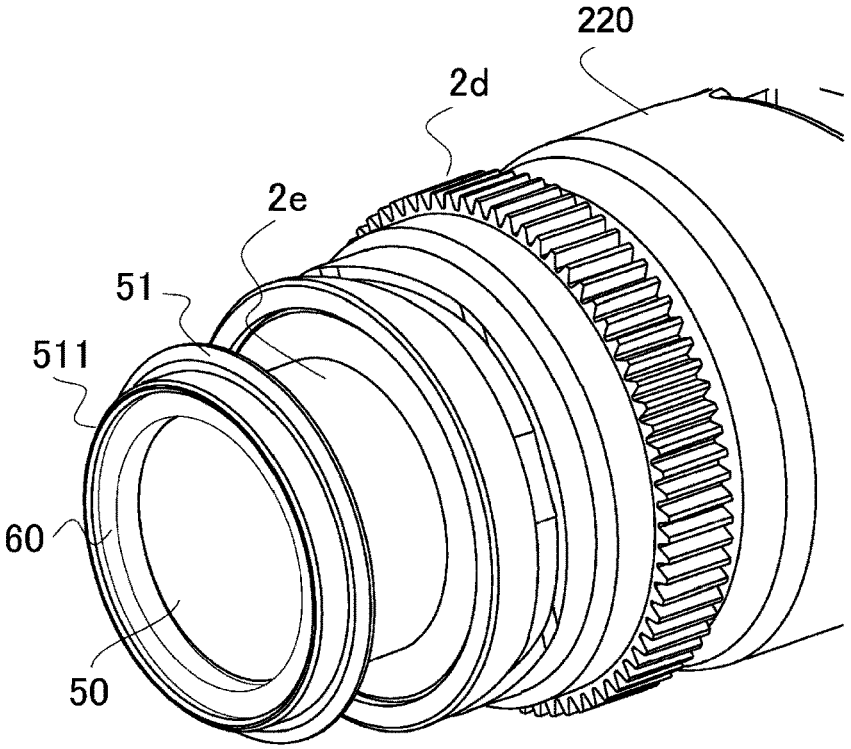

FIG. 14 is an enlarged perspective view of an accommodating portion in a third embodiment of the present invention.

Figure 15:
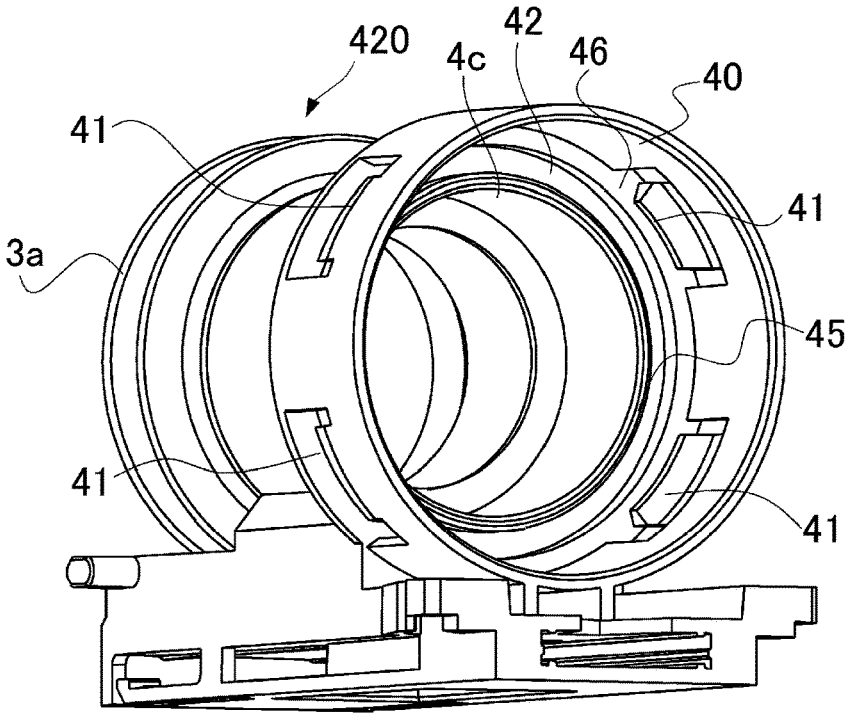

FIG. 15 is a perspective view of the flange portion in the third embodiment.

Figure 16:
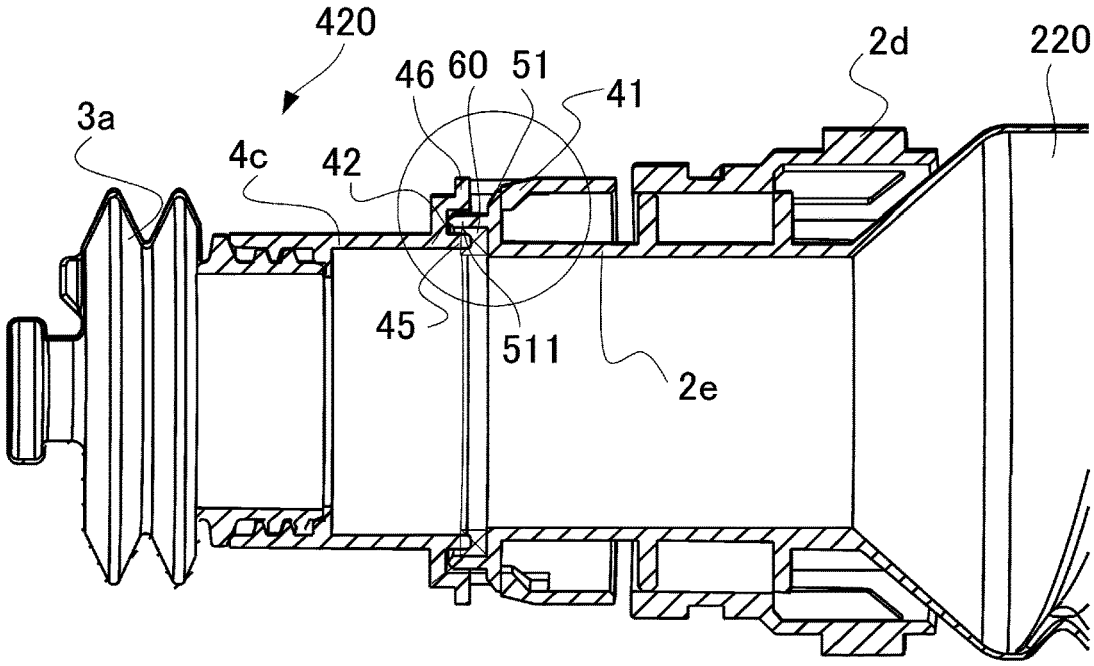
Figure 16:
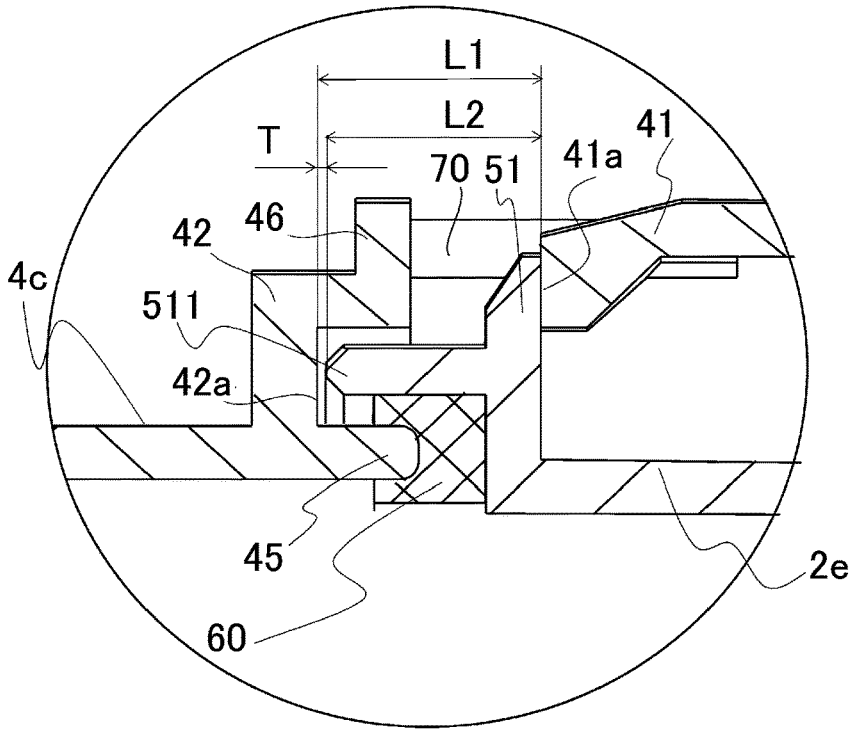

Part (a) of FIG. 16 is a partial sectional view illustrating mounting of the flange portion and the accommodating portion, and part (b) of FIG. 16 is a partial enlarged sectional view illustrating mounting of the flange portion and the accommodating portion.

Figure 17:
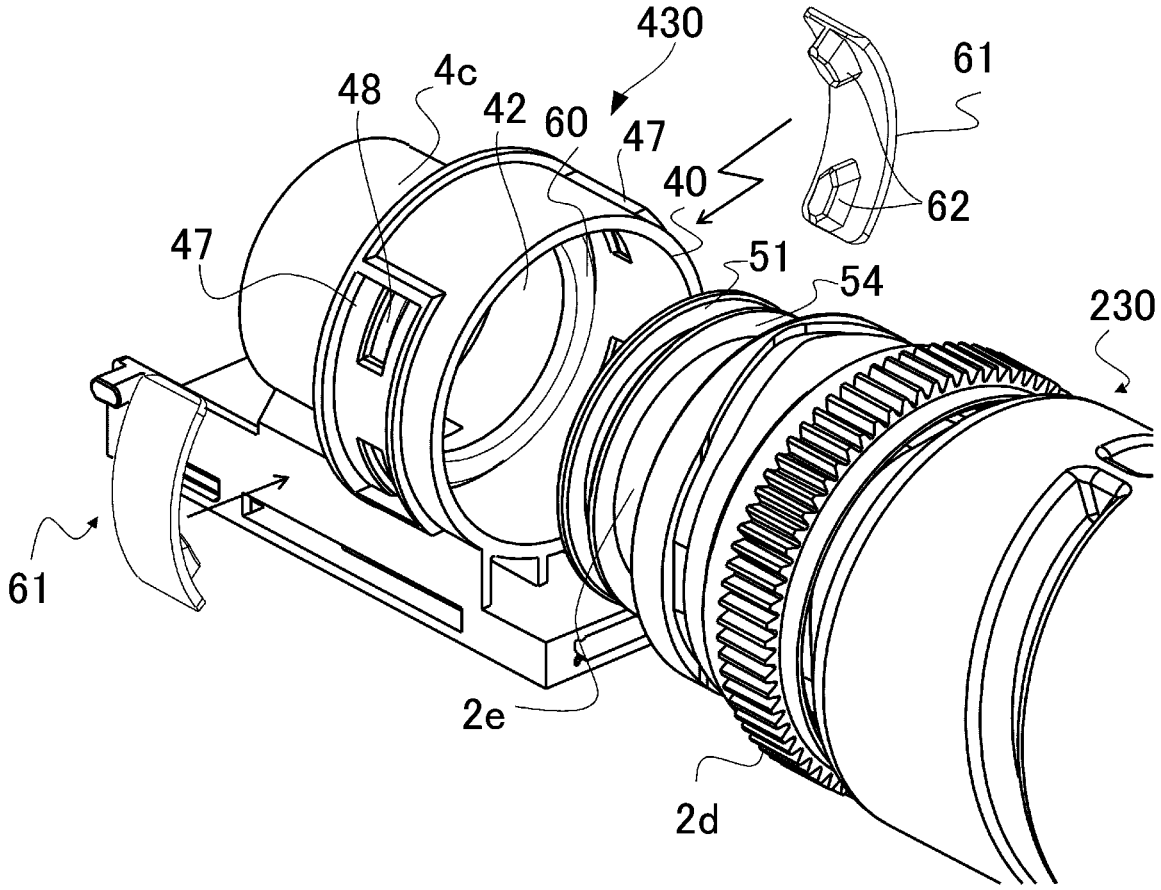

FIG. 17 is a perspective view of the accommodating portion and the flange portion in a fourth embodiment of the present invention.

Figure 18:
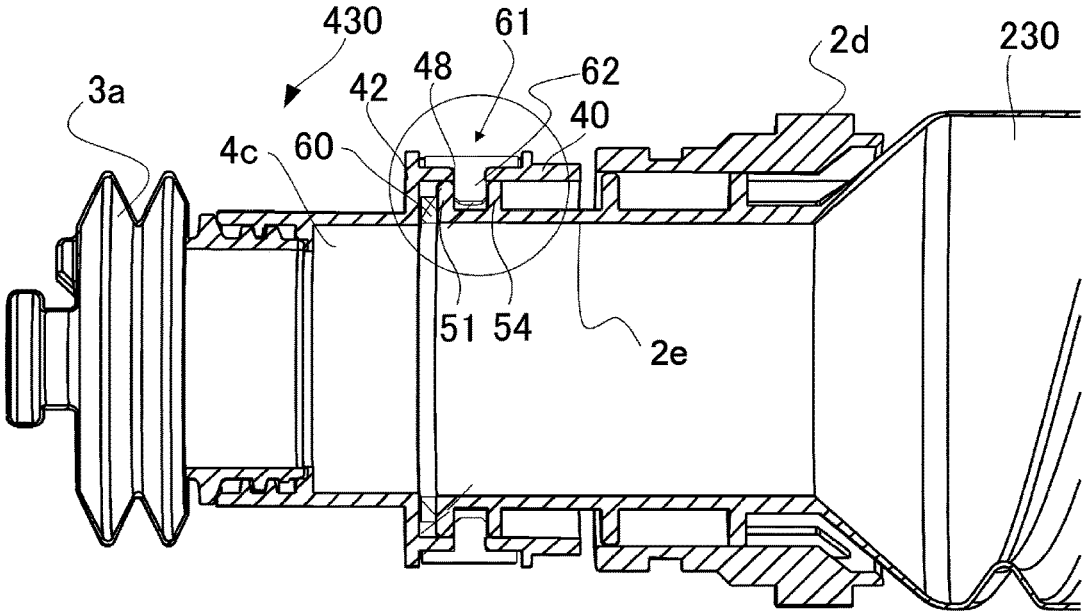
Figure 18:
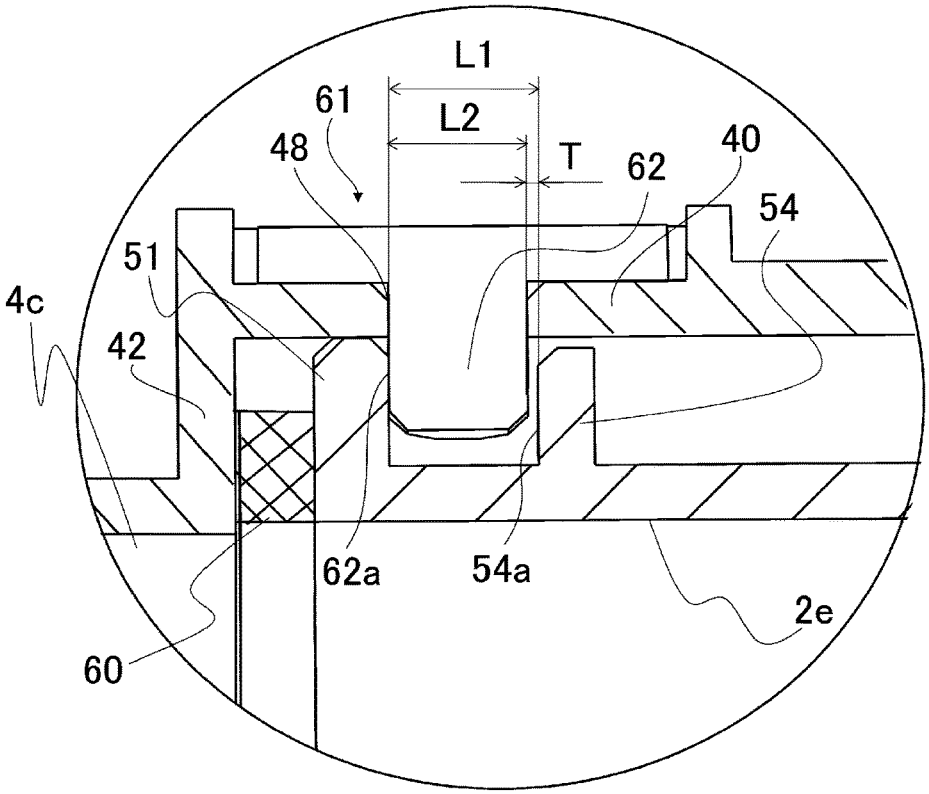

Part (a) of FIG. 18 is a partial sectional view illustrating mounting of the flange portion and the accommodating portion in the fourth embodiment, and part (b) of FIG. 18 is a partial enlarged sectional view illustrating mounting of the flange portion and the accommodating portion in the fourth embodiment.

DESCRIPTION OF EMBODIMENTS

First Embodiment

In the following, an image forming apparatus according to this embodiment will be described. First, a summary of the image forming apparatus will be described and then a developer supply device and a developer supply container which are mounted in this image forming apparatus will be described.

(Image Forming Apparatus)

As the image forming apparatus in which the developer supply container is mountable in and dismountable from the developer supply device, the image forming apparatus employing an electrophotographic type will be described with reference to FIG. 1.

Figure 1:
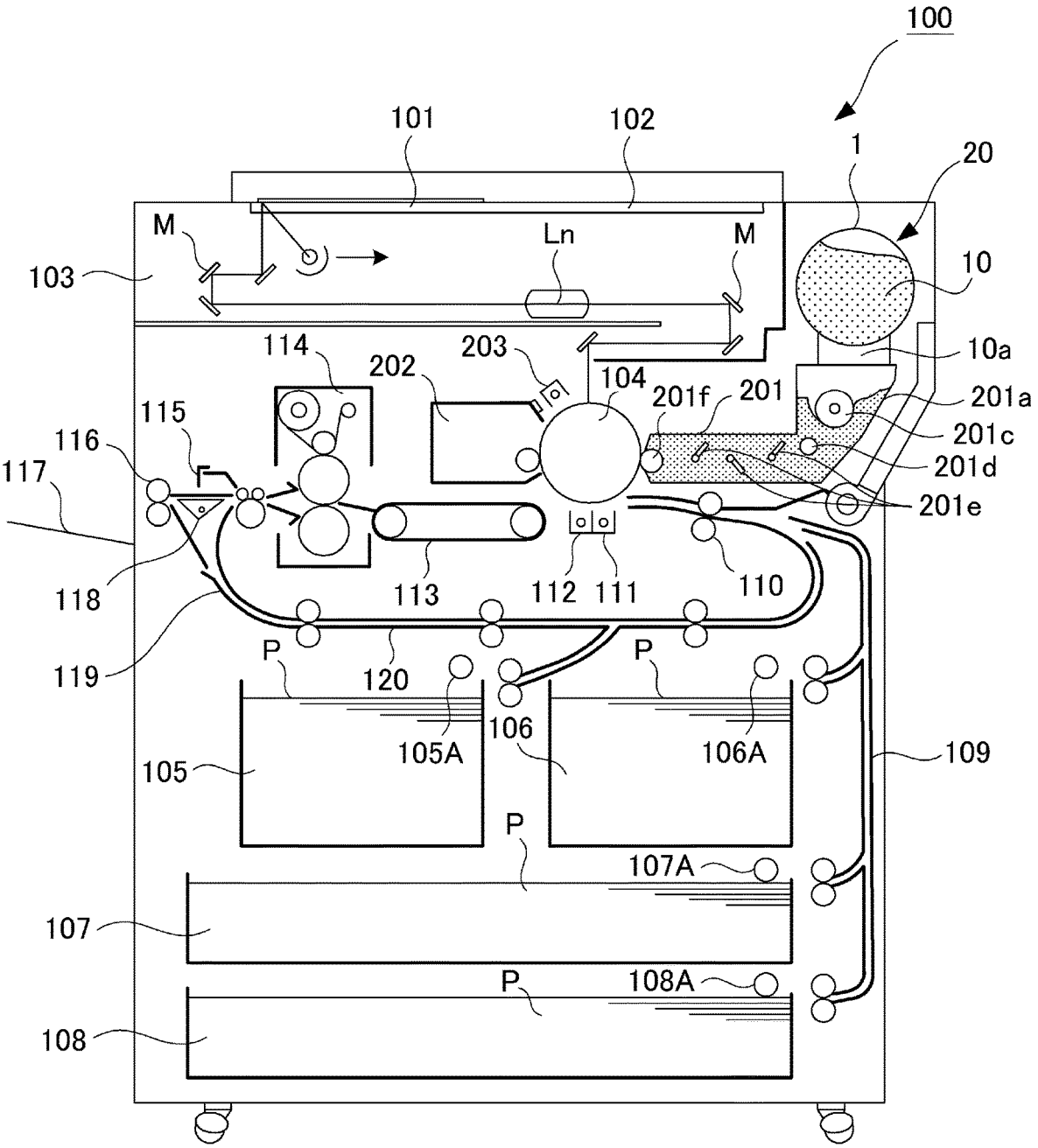
FIG. 1 is a sectional view of an image forming apparatus usable with the developer supply container according to an embodiment of the present invention.

As shown in FIG. 1, an image forming apparatus 100 includes an original supporting platen glass 102, and an original 101 is placed on this original supporting platen glass 102. Then, an optical image depending on image information of the original 101 is formed on a photosensitive member 104 electrically charged uniformly by a charger 203 in advance, by a plurality of mirrors M and a lens Ln of an optical portion 103, whereby an electrostatic latent image is formed on the photosensitive member 104. This electrostatic latent image is visualized with toner (one component magnetic toner) as a developer (dry powder) by a dry developing device (one component developing device) 201*a*. That is, a toner image (developer image) is formed on the photosensitive member 104.

In the image forming apparatus 100, a plurality of cassettes 105-108 for accommodating recording materials (hereinafter referred to as sheets) are provided. Of these cassettes 105-108 in which sheets P are stacked, the sheet P is fed from either one of the cassettes selected on the basis of information or a size of the original 101 which are inputted by an operator through an operating portion (not shown) provided on the image forming apparatus 100. Here, as the recording material (sheet), it is not limited to a sheet (paper), but for example, an OHP sheet and the like can be appropriately used and selected.

Then, a single sheet P fed by either one of feeding and separation devices 105A-108A is fed to a registration roller pair 110 via a feeding portion 109. Then, this sheet P is conveyed to a transfer portion in synchronism with rotation of the photosensitive member 104 and scanning by the optical portion 103.

The transfer portion includes a transfer charger 111 and a separation charger 112. The transfer charger 111 and the separation charger 112 are provided opposed to the photosensitive member 104. The toner image formed on the photosensitive member 104 is transferred onto the sheet P by the transfer charger 111. Then, by the separation charger 112, the sheet P on which the developer image (toner image) is transferred is separated from the photosensitive member 104.

Thereafter, the sheet P fed by a feeding portion 113 is heated and pressed in a fixing portion 114 and the developer image is fixed on the sheet P, and in the case of one-side copying, the sheet P passes through a discharging reverse portion 115 and is discharged to a discharge tray 117 by a discharging roller pair 116.

On the other hand, in the case of double-side copying, the sheet P passes through the discharging reverse portion 115, and a part of the sheet P is once discharged to an outside of the image forming apparatus 100 by the discharging roller pair 116. Thereafter, at timing when a trailing end of the sheet P passes through a flapper 118 and is still sandwiched by the discharging roller pair 116, and the sheet P is fed again in the image forming apparatus 100 by controlling the flapper 118 and by reversely rotating the discharging roller pair 116. Thereafter, the sheet P is fed to the registration roller pair 110 via re-feeding conveying portions 119 and 120, and then is fed along a path similar to the path in the case of the one-side copying and thus is discharged onto the discharge tray 117.

In the image forming apparatus 100 having the above-described constitution, around the photosensitive member 104, image forming process devices such as a developing device 201, a cleaner portion 202 and a primary charger 203 are provided. Incidentally, the developing device 201 develops the electrostatic latent image formed on the photosensitive member 104 by the optical portion 103 on the basis of the image information of the original 101, by depositing the developer on the electrostatic latent image. Further, the primary charger 203 electrically charges uniformly a photosensitive member surface in order to form a desired electrostatic latent image on the photosensitive member 104. The cleaner portion 202 removes the developer remaining on the photosensitive member 104.

(Developing Device)

Figure 2:
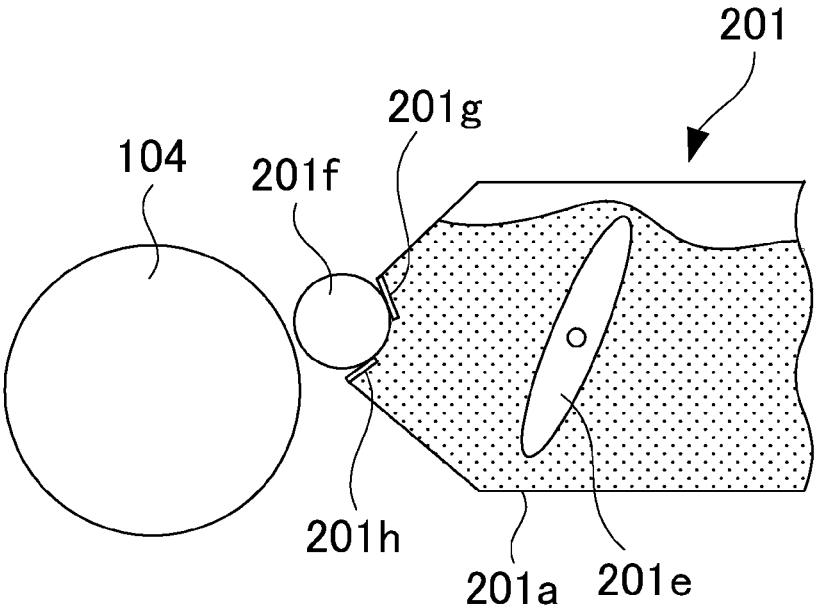
FIG. 2 is a schematic view of a developing device.

Next, the developing device 201 will be described with reference to FIGS. 1 and 2. As shown in FIGS. 1 and 2, the developing device 201 includes a developer container 201*a*, a developing roller 201*f*, a stirring member 201*c* and feeding members 201*d* and 201*e*. In the case of this embodiment, to the developing device 201, the above-described one component magnetic toner is supplied as the developer from a developer supply device 20 in which a developer supply container 1 described later is mounted. The developer supplied to the developing device 201 is stirred by the stirring member 201*c* and is sent to the developing roller 201*f*, and then is supplied to the photosensitive member 104 by the developing roller 201*f*.

In the developing device 201, a developing blade 201*g* for regulating a coat amount of the developer on the developing roller 201*f* is provided in contact with the developing roller 201*f* Further, in the developing device 201, a leakage-preventing sheet 201*h* is provided in contact with the developing roller 201*f* in order to prevent leakage of the developer from between the developing roller 201*f* and the developing container 201*a*.

In this embodiment, as the developer which should be supplied from the developer supply device 20, the one component magnetic toner is used, but the developer is not limited thereto. For example, a two component developing device in which development is carried out using a two component developer in which a magnetic carrier and non-magnetic toner are mixed with each other may also be used, and in that case, as the developer, the non-magnetic toner is supplied. In this case, a constitution in which as the developer, not only the non-magnetic toner but also the magnetic carrier are supplied in combination may also be employed.

(Developer Supply Device)

Next, the developer supply device 20 will be described using part (a) of FIG. 3 to FIG. 4 while making reference to FIG. 1. The developer supply device 20 includes, as shown in FIG. 1, a mounting portion 10 in which the developer supply container 1 is mountable and from which the developer supply container 1 is dismountable and a hopper 10*a* for temporarily storing the developer discharged from the developer supply container 1. The mounting portion 10 is a cylindrical member, in which a space for permitting accommodation of the developer supply container 1 is formed. The developer supply container 1 has a constitution in which the developer supply container 1 is inserted into the mounting portion 10 in an arrow M direction as shown in part (b) of FIG. 3. A rotational axis direction of the developer supply container 1 substantially coincides with an insertion direction in a state in which an accommodating portion 2 is not inclined. Incidentally, a dismounting direction (removing direction) of the developer supply container 1 from the mounting portion 10 is an opposite direction to the insertion direction (arrow M direction).

The mounting portion 10 is, as shown in part (a) of FIG. 3, provided with a rotational direction limiting portion 11 for limiting movement of a flange portion 4 (part (a) of FIG. 5 described later) of the developer supply container 1 in a rotational direction by contact of the rotational direction pressure limiting portion 11 with the flange portion 4.

The mounting portion 10 is provided with a developer receiving opening 13 for receiving the developer discharged from the developer supply container 1 by establishing communication with a discharge opening 4*a* of the developer supply container 1. Then, the developer discharged through the discharge opening 4*a* of the developer supply container 1 is supplied to the hopper 10*a* through the developer receiving opening 13. The hopper 10*a* includes a feeding screw 10*b* for feeding the developer toward the developing device 201, an opening 10*c* communicating with the developer device 201 and a developer sensor 10*d* for detecting an amount of the developer accommodated in the hopper 10*a*. The developer discharged from the developer supply container 1 is supplied to the developing device 201 by the hopper 10*a*.

Further, the mounting portion 10 includes a driving gear 300 functioning as a driving mechanism as shown in parts (a) and (b) of FIG. 3. To the driving gear 300, a rotational driving force is transmitted from a driving motor 500 (FIG. 4) via a gear train, and the driving gear 300 has a function of imparting the rotational driving force to a gear portion 2*d* (FIG. 4) of the developer supply container 1 in a state in which the developer supply container 1 is set in the mounting portion 10.

As shown in FIG. 4, the driving motor 500 is controlled by a control device 600 including a CPU (central processing unit), ROM (read only memory), RAM (random access memory) and the like. In the case of this embodiment, the control device 600 controls an operation of the driving motor 500 on the basis of developer remaining amount information inputted from the developer sensor 10*d*. Incidentally, in the case of the two component developing device, in place of the developer sensor 10*d*, a magnetic sensor for detecting a toner content in the developer is provided in the developing device 201, and on the basis of a detection result of this magnetic sensor, the operation of the driving motor 500 may only be required to be controlled by the control device 600.

(Developer Supply Container)

Next, the developer supply container 1 according to First Embodiment will be described with reference to part (a) of FIG. 5 to FIG. 8. The developer supply container 1 includes the accommodating portion 2 which is formed in a hollow cylindrical shape and which is provided with an inside space for permitting accommodation of the developer, and includes the flange portion 4, a feeding member 6 and a pump portion 3*a*. The accommodating portion 2 is mounted to the flange portion 4 so as to be rotatable relative to the flange portion 4 by being inserted and clearance-fitted in the flange portion 4 as a discharging portion. Further, although illustration is omitted, in the case where the developer supply container 1 is mounted in the developer supply device 20, an upstream side of the accommodating portion 2 with respect to the insertion direction is placed on the mounting portion 10 (part (a) of FIG. 3) so as to be supported from a lower portion with respect to a direction of gravitation. Therefore, the accommodating portion 2 is capable of rotating in a state in which the accommodating portion 2 is inserted relative to the flange portion 4. Incidentally, herein, in the case where "upstream" and "downstream" are mentioned unless otherwise specified, "upstream" and "downstream" refer to those with respect to the insertion direction of the accommodating portion 2, respectively.

(Accommodating Portion)

As shown in part (a) of FIG. 5, on an inner surface of the accommodating portion 2, a feeding projection 2*a* which is helically projected is provided. The feeding projection 2*a* functions as a mechanism for feeding the accommodated developer toward a discharging chamber 4*c* side (part (b) of FIG. 5) of the flange portion 4 with rotation of the feeding projection 2*a* itself. Further, as shown in FIG. 6, at an outer periphery of the accommodating portion 2, the gear portion 2*d* engageable with the driving gear 300 (part (a) of FIG. 3) of the mounting portion 10 is provided. The gear portion 2*d* receives a driving force from the driving gear 300 engaging with the gear portion 2*d*. The gear portion 2*d* has a constitution in which the gear portion 2*d* is rotatable integrally with the accommodating portion 2. For that reason, by rotation of the accommodating portion 2 rotating with rotation of the gear portion 2*d*, the developer in the accommodating portion 2 is fed in a feeding direction (arrow X direction) by the feeding projection 2*a*. Incidentally, the rotational driving force inputted from the driving gear 300 to the gear portion 2*d* is also transmitted to the pump portion 3*a* through a reciprocating member 3*b* (parts (a) and (b) of FIG. 8). The pump portion 3*a* operates so that an internal pressure of the accommodating portion 2 is alternately switched repetitively between a state in which the internal pressure is lower than ambient pressure and a state in which the internal pressure is higher than the ambient pressure by the driving force received by the gear portion 2*d*.

As shown in FIG. 6, at one end of the accommodating portion 2 on a downstream side (with respect to the insertion direction), a small diameter cylindrical portion 2*e* provided, as one end portion, with an opening 50 for permitting discharge of the developer toward the discharging chamber (discharging portion) 4*c* is formed. On an outer peripheral surface of the small diameter cylindrical portion 2*e*, a ring-shaped circular rib 51 (projected portion) projecting toward an outside of the accommodating portion 2 in a radial direction crossing a rotational axis direction of the accommodating portion 2 is provided. In this embodiment, the small diameter cylindrical portion 2*e* is extended to a side downstream of the circular rib 51 with respect to the insertion direction of the developer supply container 1 (hereinafter, this extended portion is referred to as a projected annular portion 52 for convenience).

(Flange Portion)

The flange portion 4 is provided, as shown in part (b) of FIG. 5, with the hollow discharging chamber 4*c* for temporarily storing and then discharging the developer which is fed in the accommodating portion 2 toward the operation opening 50 side and which is supplied through the opening 50. The discharging chamber 4*c* is provided with the discharge opening 4*a* at the bottom thereof. The discharge opening 4*a* is a small hole provided in a range of 0.05-5 mm in diameter. Incidentally, the shape of the discharge opening 4*a* is not limited to a circular shape, but may also be any shape having an opening area equal to an opening area of the discharge opening 4*a* having the above-described diameter. The developer inside the discharging chamber (discharging portion) 4*c* passes through a discharge path establishing communication between the discharging chamber 4*c* and the discharge opening 4*a* and is discharged to an outside of the developer supply container 1 through the discharge opening 4*a*. At a periphery of the discharge opening 4*a*, an opening seal which is perforated is provided. The developer supply container 1 is provided with a shutter 8 at the bottom of the discharging chamber 4*c* so as to sandwich the opening seal between the shutter 8 and the discharging chamber 4*c*. The shutter 8 is configured so as to close the discharge opening 4*a* in a state in which the developer supply container 1 is not mounted in the developer supply device 20 and so as to open the discharge opening 4*a* in a state in which the developer supply container 1 is mounted in the developer supply device 20. That is, the shutter 8 is capable of opening and closing the discharge opening 4*a* with a mounting and dismounting operation of the developer supply container 1 relative to the developer supply device 20.

The flange portion 4 is substantially non-rotatable in response to mounting of the developer supply container 1 in the mounting portion 10. Specifically, in order to prevent the flange portion 4 itself from rotating in the rotational direction of the accommodating portion 2, the above-described rotational direction limiting portion 11 is provided (part (a) of FIG. 3). Accordingly, in the state in which the developer supply container 1 is mounted in the mounting portion 10, the discharging chamber 4*c* of the flange portion 4 is also in a state in which rotation thereof in the rotational direction of the accommodating portion 2 is substantially prevented (but movement thereto to the extent of play is permitted). On the other hand, the accommodating portion 2 is rotatable in a developer supplying step without being subjected to limitation of rotation in the rotational direction thereof.

As shown in FIG. 7, to the flange portion 4, the pump portion 3*a* is mounted. The flange portion 4 is configured so that the accommodating portion 2 is mountable on a side opposite from the pump portion 3*a*. Specifically, in the order from an upstream side of the discharging chamber 4*c*, as portions-to-be-inserted, an upstream cylindrical portion 40 and a downstream cylindrical portion 42 which are provided for permitting mounting of the accommodating portion 2 through clearance fitting are formed. The upstream cylindrical portion 40 is provided with a plurality (four in this embodiment) of locking claws 41, each projecting from an inner peripheral surface toward an inside with respect to a radial direction, along a circumferential direction (the rotational direction of the accommodating portion 2). The locking claw 41 is provided so as to be retractable by being elastically deformed when the accommodating portion 2 is mounted. The upstream cylindrical portion 40 is provided with holes 70 on a side downstream of the locking claws 41 so that the locking claws 41 are elastically deformed easily and so that the locking claws 41 are readily formed by injection molding.

On the other hand, the downstream cylindrical portion 42 is provided with a plurality (eight in this embodiment) of limiting ribs 43, each projecting from an end surface thereof toward the accommodating portion 2 side, along the circumferential direction. In the case of this embodiment, the rollers ribs 43 as second limiting portions are disposed at a plurality of positions so as not to overlap with the locking claws 41 as seen in the insertion direction. Further, the limiting ribs 43 are provided with an interval (gap) from the locking claws 41 as first limiting portions with respect to the insertion direction. As described later, the circular rib 51 (FIG. 6) of the accommodating portion 2 is positioned between the locking claws 41 and the limiting ribs 43. Further, to the downstream cylindrical portion 42, a ring-shaped seal member 60 formed of an elastic member such as urethane foam, for example, is bonded at an end surface thereof. The seal member 60 sets a periphery of the opening 50 (opening periphery) by being provided at a position inside the limiting ribs 43 with respect to the radial direction, specifically at a position where the above-described projected annular portion 52 (FIG. 6) of the accommodating portion 2 abuts against the seal member 60. As described later (part (a) of FIG. 9), the accommodating portion 2 is mounted to the flange portion 4 so as to be rotatable relative to the flange portion 4 in a state in which the projected annular portion 52 elastically compresses the seal member 60. The seal member 60 seals the gap between the small diameter cylindrical portion 2*e* and the downstream cylindrical portion 42, and the accommodating portion 2 rotates while sliding with the seal member 60, so that hermetically in the developer supply container 1 is maintained by the seal member 60.

(Feeding Member)

Returning to part (b) of FIG. 5, in the accommodating portion 2 a plate-like feeding member 6 for feeding the developer, fed from the inside of the accommodating portion 2 by a helical feeding projection 2*a*, toward the discharging chamber 4*c* of the flange portion 4 is provided. This feeding member 6 is provided so as to divide a part of a region of the accommodating portion 2 into substantially two portions and is configured to rotate together integrally with the accommodating portion 2. Further, this feeding member 6 is provided with a plurality of inclined ribs 6*a* each inclined toward the discharging chamber 4*c* side with respect to the rotational axis direction of the accommodating portion 2 on each of opposite surfaces thereof. The developer fed by the feeding projection 2*a* is raised from below toward above with respect to a vertical direction by this plate-like feeding member 6 in interrelation with rotation of the accommodating portion 2. Thereafter, with further rotation of the accommodating portion 2, the developer is delivered toward the discharging chamber 4*c* by the inclined rib 6*a*. In this constitution, this inclined rib 6*a* is provided on the opposite surfaces of the feeding member 6 so that the developer is sent to the discharging chamber 4*c* every half rotation of the accommodating portion 2.

(Pump Portion)

In this embodiment, as described above, in order to stably discharge the developer through a small discharge opening 4*a*, the above-described pump portion 3*a* is provided at a part of the developer supply container 1. The pump portion 3*a* is a variable-volume pump in which a volume thereof is variable and which is made of a resin material. Specifically, as the pump portion 3*a*, a pump comprising a bellows-like expansion and contraction member which is capable of expansion and contraction is employed. Specifically, a bellows-like pump is employed, and a plurality of "mountain-fold" portions and "valley-fold" portions are alternately formed periodically.

The developer supply container 1 is provided with a cam mechanism functioning as a drive conversion mechanism for converting a rotational driving force, for rotating the accommodating portion 2, received by the gear portion 2*d* into a force in a direction in which the pump portion 3*a* is reciprocated. In this embodiment, a constitution in which by converting the rotational driving force received by the gear portion 2*d* into a reciprocating force on the developer supply container 1 side, a driving force for rotating the accommodating portion 2 and a driving force for reciprocating the pump portion 3*a* are received by a single drive-receiving portion (gear portion 2*d*) is employed.

Here, part (a) of FIG. 8 is a partial view of the pump portion 3*a* in a state in which the pump portion 3*a* is expanded to the maximum in use, and part (b) of FIG. 8 is a partial view of the pump portion 3*a* in a state in which the pump portion 3*a* is contracted to the maximum in use. As shown in parts (a) and (b) of FIG. 8, as an intervening member for converting the rotational driving force into the reciprocating force of the pump portion 3*a*, a reciprocating member 3*b* is used. Specifically, the gear portion 2*a* receiving the rotational driving force from the driving gear 300 and a cam groove 2*b* provided with a groove extending through one full circumference are rotated. With this cam groove 2*b*, a reciprocating member engaging projection 3*c* projected partly from the reciprocating member 3*b* engages. Further, a rotational direction of the reciprocating member 3*b* is limited by a protective cover 4*e* (part (b) of FIG. 5) so that the reciprocating member 3*b* itself does not rotate in the rotational direction of the accommodating portion 2. The reciprocating member 3*b* reciprocates along the groove of the cam groove 2*b* (in an arrow X direction or an opposite direction) by being limited in rotational direction thereof. That is, the cam groove 2*b* is rotated by the rotational driving force inputted from the driving gear 300, so that the reciprocating member engaging projection 3*c* reciprocates in the arrow X direction or the opposite direction. Correspondingly, the pump portion 3*a* alternately repeats an expanded state (part (a) of FIG. 8) and a contracted state (part (b) of FIG. 8) and thus a volume of the developer supply container 1 is made variable.

By this expansion and contraction operation of the pump portion 3*a*, a pressure in the developer supply container 1 is changed, and discharge of the developer is carried out by utilizing the pressure. Specifically, when the pump portion 3*a* is contracted, in side of the developer supply container 1 is in a pressed state, so that the developer is discharged through the discharge opening 4*a* in a manner such that the developer is pushed out by the pressure. Further, when the pump portion 3*a* is expanded, the inside of the developer supply container 1 is in a reduced pressure state, so that outside air is taken in from the outside of the developer supply container 1 through the discharge opening 4*a*. The developer in the neighborhood of the discharge opening 4*a* is loosened by the outside air taken in through the discharge opening 4*a*, so that subsequent discharge is smoothly carried out. The developer is discharged through the discharge opening 4*a* in accordance with a pressure difference between the inside pressure and the ambient pressure (outside pressure) of the developer supply container 1 generated by repetitive execution of the above-described expansion and contraction operation by the pump portion 3*a*.

Incidentally, a discharging method of the developer from the developer supply container 1 is not limited to the expansion and contraction of the above-described pump portion 3*a*. For example, the developer supply container 1 may also have a structure in which the developer supply container 1 is not provided with the pump portion and the diameter of the discharge opening 4*a* is made larger than an opening area and in which the developer deposited on the discharging chamber (discharging portion) 4*c* is discharged by gravitation. Further, the developer supply container 1 may also have a constitution in which the pump portion is not provided and the developer is sent to a discharging path by a rotatable member 6 provided just above an inlet of the discharging path.

(Material of Developer Supply Container)

In this embodiment, as described above, the constitution in which the developer is discharged through the discharge opening 4*a* by changing the volume of the inside of the developer supply container 1 by the pump portion 3*a* is employed. Therefore, as a material of the developer supply container 1, a material having rigidity to the extent that a resultant developer supply container is largely collapsed due to a volume changer or the developer supply container is not expanded may preferably be employed. In this embodiment, the developer supply container 1 communicates with the outside only through the discharge opening 4*a* during the discharge of the developer and thus has a constitution in which the developer supply container 1 is hermetically sealed from the outside except for the discharge opening 4*a*, that is, a constitution in which the developer is discharged through the discharge opening 4*a* by decreasing and increasing the volume of the developer supply container 1 by the pump portion 3*a* is employed, and therefore, hermetically to the extent that a stable discharging performance is required. Therefore, in this embodiment, a material of the accommodating portion 2 is PET resin, a material of the flange portion 4 is polystyrene resin, and a material of the pump portion 3*a* is polypropylene resin.

Incidentally, as regards the materials used, when the materials of the accommodating portion 2 and the flange portion 4 are capable of withstanding the volume change, for example, it is possible to use other resin materials such as ABS (acrylonitrile-butadiene-styrene copolymer), polyester, polyethylene and polypropylene. As regards the material of the pump portion 3*a*, the material may only be required that the material exhibits an expansion and contraction function and is capable of changing the volume of the developer supply container 1 by the volume change thereof. For example, the pump portion 3*a* may also be formed in a thin film of ABS, polystyrene, polyester, polyethylene or the like, or it is also possible to use a rubber or another material having expansion and contraction properties.

Next, a manner of mounting the above-described accommodating portion 2 and the flange portion 4 will be described with reference to parts (a) and (b) of FIG. 9. The accommodating portion 2 is rotatably clearance-fitted in the discharging chamber 4*c* of the flange portion 4 on one end side of the discharging chamber 4*c*. In the case of this embodiment, the inner peripheral surface of the upstream cylindrical portion 40 and the outer peripheral surface of the circular rib 51 are in a clearance fitting relationship. By this constitution, a position of the small diameter cylindrical portion 2*e* relative to the flange portion 4 is determined. This is for the purpose of rotating the accommodating portion 2 smoothly even when concentric deviation between a radial center of the upstream cylindrical portion 40 and a radial center of the small diameter cylindrical portion 2*e* occurs due to component part variation or the like.

In a state in which the accommodating portion 2 is clearance-fitted in the flange portion 4, movement of the accommodating portion 2 in the rotational axis direction is limited by the discharging chamber 4*c*. As shown in parts (a) and (b) of FIG. 9, the circular rib 51 of the accommodating portion 2 is locked by the locking claws 41 formed inside the upstream cylindrical portion 40 of the discharging chamber 4*c*. Then, the elastic seal member 60 provided on the end surface of the downstream cylindrical portion 42 of the discharging chamber 4*c* is pressed and compressed against the downstream cylindrical portion 42 by contact of a free end of the projected annular portion 52 (this fee end is referred to as a pressing portion 52*a* for convenience). During rotation of the accommodating portion 2, the pressing portion 52*a* slides with the seal member 60. Thus, the accommodating portion 2 is prevented from causing rotation runout by a seal repelling force generated by abutting and compressing the seal member 60 against the downstream cylindrical portion 42. Movement of the accommodating portion 2 in a direction opposite to the insertion direction by the seal repelling force is limited by the locking claws 41.

Incidentally, in the case of this embodiment, with respect to the insertion direction, a difference (T in part (b) of FIG. 9) between a length (L1 in the figure) from a free end surface 41*a* of the locking claw 41 to a limiting surface 43*a* of the limiting rib 43 and a thickness (L2 in the figure) of the circular rib 51 is set at a range of "0.25±0.15 mm", for example. That is, in a state in which the accommodating portion 2 is not inclined relative to the discharging chamber 4*c*, a movable length of the accommodating portion 2 in the insertion direction is set at 0.1 mm or more and 0.4 mm or less. In other words, the limiting ribs 43 have the gap with the circular rib 51 with respect to the insertion direction in a state in which the limiting ribs 43 does not limit inclination of the accommodating portion 2, and the gap is set at 0.1 mm or more and 0.4 mm or less. Further, in the state in which the accommodating portion 2 is not inclined, the accommodating portion 2 is locked by the locking claws 41 so that the thickness thereof (E1 in the figure) after compression is, for example, "2 mm" relative to the thickness thereof (E0 in the figure), after the compression, which is "3 mm".

Next, limitation of movement of the accommodating portion 2 in the radial direction during rotation will be described with reference to FIG. 10. As shown in FIG. 10, the accommodating portion 2 is rotated by transmission of the rotational drive (rotatable driving force) from the driving gear 300 to the gear portion 2*d* provided at the outer periphery of the accommodating portion 2. When the accommodating portion 2 is rotated, in the accommodating portion 2, a radial load is capable of generating in the radial direction (specifically an arrow F direction in FIG. 10) due to a rotational load by the driving gear 300. An upstream side of the accommodating portion 2 is mounted in the mounting portion 10, and therefore, when the radial load generates, the accommodating portion 2 is inclined in the arrow F direction in FIG. 10 relative to the discharging chamber 43 by the influence thereof, so that the rotation runout can occur not a little. The rotational load of the accommodating portion 2 is not constant but fluctuates, and therefore, a degree of the rotation runout is also not constant. Incidentally, herein, the state in which the accommodating portion 2 is inclined relative to the discharging chamber 4*c* refers to a state in which a rectilinear line R passing through a radial center of the downstream cylindrical portion 42 (and the upstream cylindrical portion 40) and a rotational axis R' of the accommodating portion 2 cross each other. On the other hand, a state in which the accommodating portion 2 is not inclined relative to the discharging chamber 4*c* refers to a state in which the above-described rectilinear line R and the rotational axis R' are parallel to each other (do not cross each other).

In the case of this embodiment, when the radial load is generated by the driving gear 300, while the circular rib 51 of the accommodating portion 2 is kept in a locked state by the locking claws 41 on the driving gear 300 side, the accommodating portion 2 is inclined while being rotated. On the other hand, on an opposite side where the accommodating portion 2 is rotated (moved) 180° from the driving gear 300 in the circumferential direction thereof, the circular rib 51 abuts and contacts the limiting surfaces 43*a* of the limiting ribs 43. When the accommodating portion 2 is inclined, the pressure applied to the seal member 60 by the pressing portion 52*a* is different between the driving gear 300 side and the opposite side from the driving gear 300 side. A difference, in pressure applied to the seal member 60 by the pressing portion 52*a*, between the driving gear 300 side and the opposite side from the driving gear 300 side increases with an increasing degree of the inclination of the accommodating portion 2.

In the case of this embodiment, the inclination of the accommodating portion 2 is suppressed by the circular rib 51 and the locking claws 41 on the driving gear 300 side and is suppressed by the circular rib 51 and the limiting ribs 43 on the opposite side from the driving gear 300 side. Thus, an inclination of the rotational axis R' of the accommodating portion 2 relative to the rectilinear line R passing through the radial center of the downstream cylindrical portion 42 can be limited to within a predetermined range. As a result, even when the accommodating portion 2 is inclined, the inclination of the accommodating portion 2 does not fluctuate during rotation, so that the pressure applied to the seal member 60 does not largely fluctuate. That is, the seal member 60 cannot be largely deformed locally.

Here, in this embodiment ("FIRST EMB.") and a conventional example ("CONV. EX."), a comparison result of thicknesses of the seal members 60 in the case where the accommodating portions 2 are rotated in the inclined state is shown in FIG. 11. In the conventional example, compared with this embodiment, a constitution in which the flange portion 4 is not provided with the limiting ribs 43 is employed. Incidentally, in FIG. 11, the ordinate represents one rotation (cyclic) period of the accommodating portion 2, and the abscissa represents only a seal thickness of the seal member 60 at an arbitrary seal contact position, i.e., a position of the pressing portion 52*a* on the basis of the end surface of the downstream cylindrical portion 42 as a reference position.

As can be understood from FIG. 11, when the accommodating portion 2 causes the rotation runout, every rotation of the accommodating portion 2, the pressing portion 52*a* repeats displacement in a direction of compressing the seal member 60 while being slightly deviated in the radial direction from a desired seal contact position E1. For this reason, the seal member 60 repeats excessive compression in a compression amount which is a desired compression amount or more. The excessive compression amount was represented by E in FIG. 11. In this embodiment, compared with the conventional example, the excessive compression amount was able to be suppressed to 30%. That is, it was possible to suppress the deformation of the seal member 60 due to the rotation of the accommodating portion 2 in the inclined state relative to the discharging chamber 4*c*.

As described above, according to this embodiment, in the case where the accommodating portion 2 is rotated by the driving gear 300 in the inclined state, the circular rib 51 of the accommodating portion 2 contacts the locking claws 41 on the driving gear 300 side and contacts the limiting ribs 43 on the opposite side from the driving gear 300 side, and thus suppresses the inclination of the accommodating portion 2. As a result, the pressure applied to the seal member 60 in the rotational axis direction cannot fluctuate largely, so that the seal member 60 cannot be largely deformed locally. Thus, in this embodiment, while suppressing the rotation runout of the accommodating portion 2 by the seal member 60, deformation of the seal member 60 due to the rotation of the accommodating portion 2 in the inclined state relative to the discharging chamber 4*c* can be suppressed by a simple constitution.

Second Embodiment

A developer supply container of Second Embodiment will be described with reference to FIG. 12 to part (b) of FIG. 13. The developer supply container of Second Embodiment includes an accommodating portion 210 which is formed in a hollow cylindrical shape and which accommodates the developer therein, and includes a flange portion 410. Also in Second Embodiment, the above-described feeding member 6 and the above-described pump portion 3*a* are provided, but these are similar to those in the above-described First Embodiment, and therefore will be omitted from description. Further, constituent elements which are the same as those in the above-described First Embodiment will be omitted from description or briefly described by adding the same reference numerals or symbols thereto.

(Flange Portion)

The flange portion 410 will be described. The flange portion 410 shown in FIG. 12 includes, in place of the limiting ribs 43, a plurality of opposing limiting portions 44 which project from the end surface of the downstream cylindrical portion 42 toward the accommodating portion 210 (part (a) of FIG. 13) side and which extend along the circumferential direction of the flange portion 410 when compared with the above-described flange portion 4 of FIG. 7. Each of the opposing limiting portions 44 is provided opposed to the associated locking claw 41 with an interval (gap) from the locking claw 41 with respect to the rotational axis direction so as to overlap with the locking claw 41 as seen in the insertion direction. As regards the opposing limiting portions 44 and the locking claws 41, one or a plurality of these members may only be required to be disposed so as to partially overlap with each other of the plurality of these members. Further, in the case of this embodiment, between the locking claw 41 and the opposing limiting portion 44, as described later, the circular rib 51 and a downstream circular rib 53 (part (a) of FIG. 13) are positioned. The opposing limiting portion 44 is formed simultaneously with a free end surface 41*a* (part (b) of FIG. 13) of the locking claw 41 on the basis of the same metal mold when the flange portion 410 is prepared by injection molding, and therefore, an occurrence of a variation in gap with the locking claw 41 is readily suppressed. Incidentally, this embodiment is not limited to formation of the opposing limiting portions 44 in place of the limiting ribs 43, but both the limiting ribs 43 and the opposing limiting portions 44 may also be formed. However, in that case, there is a need that the limiting ribs 43 are disposed at the same positions as those of the opposing limiting portions 44 with respect to the rotational axis direction and that the gap between the limiting rib 43 and the locking claw 41 is made substantially coincide with the gap between the opposing limiting portion 44 and the locking claw 41.

(Accommodating Portion)

The accommodating portion 210 will be described. As shown in parts (a) and (b) of FIG. 13, on the outer peripheral surface of the small diameter cylindrical portion 2*e*, in addition to the ring-shaped circular rib 51 projecting toward the outside of the accommodating portion 210 in the radial direction crossing the rotational axis direction of the accommodating portion 210, a ring-shaped downstream circular rib 53 is provided on a side downstream of the circular rib 51. The downstream circular rib 53 as a second portion is provided downstream of the circular rib 51 as a first portion with a gap from the circular rib 51, and an outer diameter thereof is smaller than an outer diameter of the circular rib 51.

Incidentally, in the case of this embodiment, with respect to the rotational axis direction, a difference (T in part (b) of FIG. 13) between a length (L1 in the figure) from a free end surface 41*a* of the locking claw 41 to a limiting surface 44*a* of the opposing limiting portion 44 and a length (L2 in the figure) from the free end surface 41*a* to a downstream end surface of the downstream circular rib 53 is set within a predetermined range. The predetermined range is "0.25±0.15 mm", for example. In other words, in a state in which the accommodating portion 210 is not inclined relative to the discharging chamber 4*c*, a movable length of the accommodating portion 210 in the rotational axis direction is set at 0.1 mm or more and 0.4 mm or less.

The accommodating portion 210 is clearance-fitted rotatably on one end side of the discharging chamber 4*c*. In a state in which the accommodating portion 210 is clearance-fitted, as shown in part (a) and (b) of FIG. 13, the circular rib 51 of the accommodating portion 210 is locked by the locking claws 41. Movement of the accommodating portion 210 in the rotational axis direction (specifically an opposite direction to the insertion direction) by the seal repelling force is limited by the locking claws 41.

In the case of this embodiment, when the radial load F is generated by the driving gear 300 (FIG. 10), while the circular rib 51 is kept in a locked state by the locking claws 41, the accommodating portion 210 is inclined while being rotated. Then, on the driving gear 300 side, the downstream circular rib 53 moves so as to be separated from the limiting surfaces 44*a* of the opposing limiting portions 44. On the other hand, on an opposite side where the accommodating portion 210 is rotated (moved) 180° from the driving gear 300 in the circumferential direction thereof, the downstream circular rib 53 abuts and contacts the limiting surfaces 44*a* of the opposing limiting portions 44. When the accommodating portion 210 is inclined, the pressure applied to the seal member 60 by the pressing portion 52*a* is different between the driving gear 300 side and the opposite side from the driving gear 300 side.

As described above, in the case of this embodiment, the inclination of the accommodating portion 210 is suppressed by the circular rib 51 and the locking claws 41 on the driving gear 300 side and is suppressed by the downstream circular rib 53 and the opposing limiting portions 44 on the opposite side from the driving gear 300 side. As a result, even when the accommodating portion 210 is inclined, the pressure applied to the seal member 60 with respect to the rotational axis direction does not largely fluctuate.

Therefore, the pressure applied to the seal member 60 in the rotational axis direction does not fluctuate largely with respect to the circumferential direction, so that the seal member 60 cannot be largely deformed locally. Accordingly, also by this embodiment, an effect such that while suppressing the rotation runout of the accommodating portion 210 by the seal member 60, deformation of the seal member 60 due to the rotation of the accommodating portion 210 in the inclined state relative to the discharging chamber 4*c* can be suppressed by a simple constitution is achieved.

Third Embodiment

A developer supply container of Third Embodiment will be described with reference to FIG. 14 to part (b) of FIG. 16. The developer supply container of Third Embodiment includes an accommodating portion 220 which is formed in a hollow cylindrical shape and which accommodates the developer therein, and includes a flange portion 420. Also in Third Embodiment, the above-described feeding member 6 and the above-described pump portion 3*a* are provided, but these are similar to those in the above-described First Embodiment, and therefore will be omitted from description. Further, constituent elements which are the same as those in the above-described First Embodiment will be omitted from description or briefly described by adding the same reference numerals or symbols thereto.

(Accommodating Portion)

The accommodating portion 220 will be described. As shown in FIG. 14, at one end portion of the accommodating portion 220 on a downstream side, the small diameter cylindrical portion 2*e* provided with the opening 50 for permitting discharge of the developer is formed. On a free end side of the small diameter cylindrical portion 2*e*, the ring-shaped circular rib 51 projecting outward in the radial direction is provided. However, this embodiment is different from the above-described First Embodiment, the small diameter cylindrical portion 2*e* is not extended to the side downstream of the circular rib 51 (i.e., the projected annular portion 52 is not formed). Instead, a free end cylindrical portion 511 as a projection is formed so as to extend from the end surface of the circular rib 51 toward a downstream side. The free end cylindrical portion 511 is formed so that an inner diameter thereof is larger than the outer diameter of the small diameter cylindrical portion 2*e* and is smaller than the outer diameter of the circular rib 51. In the case of this embodiment, the seal member 60 is bonded to the circular rib 51 so as to extend along an inner periphery of the free end cylindrical portion 511.

(Flange Portion)

The flange portion 420 will be described. The flange portion 420 shown in FIG. 15 is not provided with the limiting ribs 43 when compared with the above-described flange portion 4 of FIG. 7. Further, the downstream cylindrical portion 42 is provided with a ring-shaped seal abutment portion 45 for compressing and sandwiching the seal member 60 between itself and the circular rib 51. The ring-shaped seal abutment portion 45 is, as shown in parts (a) and (b) of FIG. 16, provided so as to project from the end surface 42*a* of the downstream cylindrical portion 42 in the opposite direction to the insertion direction. Further, in the case of this embodiment, the downstream cylindrical portion 42 is provided with an intermediary cylindrical portion 46 provided so as to project from the end surface 42*a* of the downstream cylindrical portion 42 in the opposite direction to the insertion direction so that the free end cylindrical portion 511 is loosely engaged between the intermediary cylindrical portion 46 and the seal abutment portion 45 with respect to the radial direction. The intermediary cylindrical portion is formed so that an inner diameter thereof is larger than an outer diameter of the seal abutment portion 45.

The accommodating portion 220 is clearance-fitted rotatably in the discharging chamber 4*c* of the flange portion 420 on one end side thereof. In the case of this embodiment, as shown in parts (a) and (b) of FIG. 16, movement of the accommodating portion 220 in the rotational axis direction is limited by locking of the circular rib 51 by the locking claws 41 in a state in which the accommodating portion 220 is clearance-fitted in the discharging chamber 4*c*. In that state, the seal member 60 is compressed by being sandwiched between the circular rib 51 and the seal abutment portion 45, and thus seals a space between the downstream cylindrical portion 42 (the seal abutment portion 45 and the intermediary cylindrical portion 46) and the free end cylindrical portion 511. During rotation of the accommodating portion 220, the seal abutment portion 45 is slid by the seal member 60. Thus, by the seal repelling force generated by pressing and compressing the seal member 60 in the insertion direction, the accommodating portion 220 is prevented from causing the rotation runout. Further, the free end cylindrical portion 511 is loosely engaged between the intermediary cylindrical portion 46 and the seal abutment portion 45 with respect to the radial direction. That is, the downstream cylindrical portion 42, the seal abutment portion 45 and the intermediary cylindrical portion 46 form a recessed portion where the free end cylindrical portion 511 is capable of entering.

Incidentally, in the case of this embodiment, with respect to the rotational axis direction, a difference (T in part (b) of FIG. 16) between a length (L1 in the figure) from a free end surface 41*a* of the locking claw 41 to the end surface 42*a* of the downstream cylindrical portion 42 and a length (L2 in the figure) from the free end surface 41*a* to the end portion free end cylindrical portion 511 of the is set at a range of "0.25±0.15 mm", for example. In other words, in a state in which the accommodating portion 220 is not inclined relative to the discharging chamber 4*c*, a movable length of the accommodating portion 220 in the rotational axis direction is set at 0.1 mm or more and 0.4 mm or less.

In the case of this embodiment, when the radial load F is generated by the driving gear 300 (FIG. 10), while the circular rib 51 is kept in a locked state by the locking claws 41, the accommodating portion 210 is inclined while being rotated. Then, on the driving gear 300 side, and on an opposite side where the accommodating portion 220 is rotated (moved) 180° from the driving gear 300 in the circumferential direction thereof, the free end cylindrical portion 511 is contacted to and sandwiched between the intermediary cylindrical portion 46 and the seal abutment portion 45. When the accommodating portion 220 is inclined, the pressure applied to the seal member 60 by the pressing portion 52*a* is different between the driving gear 300 side and the opposite side from the driving gear 300 side.

As described above, in the case of this embodiment, the inclination of the accommodating portion 220 is suppressed by the free end cylindrical portion 511, the intermediary cylindrical portion 46 and the seal abutment portion 45. As a result, even when the accommodating portion 220 is inclined, the pressure applied to the seal member 60 with respect to the rotational axis direction does not largely fluctuate.

Therefore, the pressure applied to the seal member 60 in the rotational axis direction does not fluctuate largely with respect to the circumferential direction, so that the seal member 60 cannot be largely deformed locally. Accordingly, also by this embodiment, an effect such that while suppressing the rotation runout of the accommodating portion 220 by the seal member 60, deformation of the seal member 60 due to the rotation of the accommodating portion 220 in the inclined state relative to the discharging chamber 4*c* can be suppressed by a simple constitution is achieved.

Fourth Embodiment

A developer supply container of Fourth Embodiment will be described with reference to FIG. 17 to part (b) of FIG. 18. The developer supply container of Fourth Embodiment includes an accommodating portion 230 which is formed in a hollow cylindrical shape and which accommodates the developer therein, and includes a flange portion 430. When compared with the above-described First to Third Embodiments, this embodiment is largely different from the above-described First to Third Embodiments in that after the accommodating portion 230 is inserted into the flange portion 430, positional limiting members 61 each provided with locking claws 62 are made mountable o the flange portion 430 (post-mounting). Also in Fourth Embodiment, the above-described feeding member 6 and the above-described pump portion 3*a* are provided, but these are similar to those in the above-described First Embodiment, and therefore will be omitted from description. Further, constituent elements which are the same as those in the above-described First Embodiment will be omitted from description or briefly described by adding the same reference numerals or symbols thereto.

(Flange Portion)

The flange portion 430 will be described. The flange portion 430 shown in FIG. 17 does not include the limiting ribs 43, and from which the locking claws 62 are dismountable. That is, the discharging chamber 4*c* is provided with the upstream cylindrical portion 40 and the downstream cylindrical portion 42 which are used for permitting mounting of the accommodating portion 230 through clearance fitting, and the upstream cylindrical portion 40 is provided with a plurality of slits 47 (four slits in this embodiment) in an outer peripheral surface thereof along a circumferential direction. Each of the slits 47 is provided with a plurality of communication holes 48 (two holes in this embodiment) establishing communication between an inside and an outside of the upstream cylindrical portion 40. Each slit 47 is configured so that the positional limiting member 61 is mountable in and dismountable from the slit 47 after the accommodating portion 230 is inserted into the flange portion 430. The positional limiting member 61 as a limiting portion is provided with a plurality of locking claws 62 (two locking claws in this embodiment) at positions corresponding to the communication holes 48 so that each of the locking claws 62 projects from the inner peripheral surface of the upstream cylindrical portion 40 toward the inside with respect to the radial direction through the communication hole 48 in a state in which the positional limiting member 61 is mounted on the slit 47. On the other hand, to an end surface of the downstream cylindrical portion 42, the seal member 60 is bonded. The seal member 60 is provided at a position where the small diameter cylindrical portion 2*e* of the accommodating portion 230 abuts against the seal member 60.

(Accommodating Portion)

On the other hand, as shown in FIG. 17, at one end of the accommodating portion 230 on a downstream side, the small diameter cylindrical portion 2*e* as one end portion is formed. On an outer peripheral surface of the small diameter cylindrical portion 2*e*, a ring-shaped circular rib 51 and an upstream circular rib 54 positioned upstream of the circular rib 51, which project toward an outside of the small diameter cylindrical portion 2*e* in the radial direction are provided. In the case of this embodiment, the projected annular portion 52 (FIG. 6) is not formed.

In this embodiment, in a state in which the positional limiting members 61 are mounted in the slits 47, as shown in part (a) and (b) of FIG. 18, each of the locking claws 62 enters between the circular rib 51 as a second projected portion and the upstream circular rib 54 as a first projected portion. The circular rib 51 is locked by the locking claw 62. That is, movement of the accommodating portion 230 in the rotational axis direction is limited by locking the circular rib 51 by the locking claw 62 in a state in which the accommodating portion 230 is clearance-fitted in the discharging chamber 4*c*. Then, the seal member 60 is compressed by being pressed against the downstream cylindrical portion 42 by the end surface of the small diameter cylindrical portion 2*e*. During rotation of the accommodating portion 230, the small diameter cylindrical portion 2*e* slides on the seal member 60. Thus, by the seal repelling force generated by compressing the photosensitive member 104 in the insertion direction through pressing, the accommodating portion 230 is prevented from causing rotation runout.

In the case of this embodiment, when the radial load F is generated by the driving gear 300 (FIG. 10), while the circular rib 51 is kept in a locked state by the locking claws 41, the accommodating portion 230 is inclined while being rotated. Then, on the driving gear 300 side, the upstream circular rib 54 moves so as to be separated from the locking claws 62. On the other hand, on an opposite side where the accommodating portion 230 is rotated (moved) 180° from the driving gear 300 in the circumferential direction thereof, the upstream circular rib 54 abuts and contacts the locking claws 62.

Incidentally, in the case of this embodiment, with respect to the insertion direction, a difference (T in part (b) of FIG. 18) between a length (L1 in the figure) from a locking surface 62*a* of the locking claw 62 to a surface-to-be-locked 54*a* of the upstream circular rib 54 and a thickness (L2 in the figure) of the locking claw 62 is set at a range of "0.25±0.15 mm", for example. In other words, in a state in which the accommodating portion 230 is not inclined relative to the discharging chamber 4*c*, a movable length of the accommodating portion 230 in the rotational axis direction is set at 0.1 mm or more and 0.4 mm or less.

As described above, in the case of this embodiment, the accommodating portion 230 is configured so that the inclination of the accommodating portion 230 is suppressed by the circular rib 51 and the locking claws 62 on the driving gear 300 side and is suppressed by the upstream circular rib 54 and the locking claws 62 on the opposite side from the driving gear 300 side. As a result, even when the accommodating portion 230 is inclined, the pressure applied to the seal member 60 with respect to the rotational axis direction does not largely fluctuate.

Accordingly, the pressure applied to the seal member 60 in the rotational axis direction does not fluctuate largely with respect to the circumferential direction, so that the seal member 60 cannot be largely deformed locally. Accordingly, also by this embodiment, an effect such that while suppressing the rotation runout of the accommodating portion 230 by the seal member 60, deformation of the seal member 60 due to the rotation of the accommodating portion 230 in the inclined state relative to the discharging chamber 4*c* can be suppressed by a simple constitution is achieved.

Other Embodiments

Incidentally, the developer supply container 1 of this embodiment may also be a developer supply container 1 in which the pump portion 3*a* is not provided. In this case, constituent elements other than the pump portion 3*a* may also be similar to those in the above-described embodiments. As regards the feeding of the developer in the developer supply container 1, a constitution in which the developer is fed toward the discharging chamber 4*c* by the accommodating portion 2 (210, 220, 230) and the feeding member 6 may also be employed.

According to the present invention, while suppressing the rotation runout of the accommodating portion by the seal member, deformation of the seal member due to rotation of the accommodating portion in the state in which the accommodating portion is inclined relative to the discharging portion can be suppressed by a simple constitution.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-162135 filed on Aug. 30, 2018, which is hereby incorporated by reference herein in its entirety.

What is claimed is:

1. A developer supply container comprising:

an accommodating portion having an inside wall provided with a helical projection that is capable of feeding developer, the accommodating portion including a first cylindrical portion provided with a circular rib forming a circular opening through which the developer is fed by the helical projection;

a discharging portion capable of discharging the developer, the discharging portion including (i) a second cylindrical portion provided with a receiving opening capable of receiving the developer passed through the circular opening, wherein the first cylindrical portion is inserted into the second cylindrical portion such that the accommodating portion is rotatable relative to the discharging portion and the developer is capable of being fed from the circular opening into the receiving opening, and (ii) a discharge chamber provided with a discharge opening through which the developer received from the accommodating portion through the receiving opening is discharged to outside of the developer supply container;

a gear provided on the accommodating portion and configured to receive a driving force for rotating the accommodating portion relative to the discharge opening, the gear being provided between the circular rib and the helical projection in a rotational axis direction of the accommodating portion; and a sealing member elastically deformed by being sandwiched by the receiving opening and an end surface of the circular rib in the rotational axis direction, wherein the accommodating portion is further provided with an annular projection projecting from the first cylindrical portion between the end surface of the circular rib and the gear, wherein the discharge portion is further provided with an engaging claw provided between the annular projection and the gear, wherein an engaging portion is provided between the annular projection and the end surface of the circular rib in the rotational axis direction, and wherein the annular projection is positioned so as to be sandwiched between the engaging claw and the engaging portion, with a gap provided between the annular projection and the engaging portion by the annular projection contacting the engaging claw that is more than 0.1 mm and not more than 0.4 mm.

2. A developer supply container according to claim 1, wherein the engaging claw locks the annular projection so as to prevent the first cylindrical portion of the accommodating portion from disengaging from the second cylindrical portion of the discharging portion.

3. A developer supply container according to claim 1, wherein the second cylindrical portion of the discharging portion is provided with a hole at a position that is towards the engaging portion from the engaging claw.

* * * * *